US010669061B2

(12) United States Patent
Smalley et al.

(10) Patent No.: US 10,669,061 B2
(45) Date of Patent: Jun. 2, 2020

(54) CARTON WITH ASYMMETRICAL CORNERS

(71) Applicant: Graphic Packaging International, Inc., Atlanta, GA (US)

(72) Inventors: Brian Smalley, Bristol (GB); Steve M. Gould, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 90 days.

(21) Appl. No.: 15/799,046

(22) Filed: Oct. 31, 2017

(65) Prior Publication Data

US 2018/0118402 A1 May 3, 2018

Related U.S. Application Data

(60) Provisional application No. 62/416,231, filed on Nov. 2, 2016.

(51) Int. Cl.

| | |
|---|---|
| ***B65D 5/02*** | (2006.01) |
| ***B65D 5/54*** | (2006.01) |
| ***B31B 50/26*** | (2017.01) |
| ***B65D 5/10*** | (2006.01) |
| ***B65D 5/42*** | (2006.01) |

(Continued)

(52) U.S. Cl.

CPC ..... *B65D 5/0209* (2013.01); *B31B 50/262* (2017.08); *B65D 5/029* (2013.01); *B65D 5/0227* (2013.01); *B65D 5/10* (2013.01); *B65D 5/4266* (2013.01); *B65D 5/50* (2013.01);

(Continued)

(58) Field of Classification Search

CPC ..... B65D 5/029; B65D 5/008; B65D 5/3614; B65D 5/4266; Y10S 206/822; Y10S 229/934

See application file for complete search history.

(56) References Cited

U.S. PATENT DOCUMENTS

| | | | |
|---|---|---|---|
| 2,849,111 | A | 8/1958 | Fielding |
| 2,922,561 | A | 1/1960 | Currivan |

(Continued)

FOREIGN PATENT DOCUMENTS

| | | |
|---|---|---|
| BE | 671.762 | 3/1966 |
| CA | 2135930 A1 | 10/1994 |

(Continued)

OTHER PUBLICATIONS

International Search Report and Written Opinion for PCT/US2017/059230 dated Feb. 22, 2018.

(Continued)

*Primary Examiner* — Brian D Nash

(74) *Attorney, Agent, or Firm* — Womble Bond Dickinson (US) LLP

(57) ABSTRACT

A carton for holding at least one article. The carton includes a plurality of panels that extends at least partially around an interior of the carton and a plurality of end flaps respectively foldably connected to a respective panel of the plurality of panels for closing at least one closed end of the carton. The carton comprises at least one asymmetrical corner extending between a top of the carton and a bottom of the carton and that transitions between a first configuration at one of the top and the bottom of the carton and a second configuration at the other of the top and the bottom of the carton.

63 Claims, 12 Drawing Sheets

(51) Int. Cl.
*B65D 5/50* (2006.01)
*B65D 5/72* (2006.01)
*B31B 110/35* (2017.01)

(52) U.S. Cl.
CPC ..... *B65D 5/542* (2013.01); *B65D 5/725* (2013.01); *B31B 2110/35* (2017.08)

(56) References Cited

U.S. PATENT DOCUMENTS 2,928,541 A 3/1960 Fielding
3,178,242 A 4/1965 Ellis
3,300,115 A 1/1967 Schauer
3,306,519 A 2/1967 Wood
3,339,723 A 9/1967 Wood
3,356,279 A 12/1967 Root
3,373,867 A 3/1968 Wood
3,593,849 A 7/1971 Helms
3,635,452 A 1/1972 Helms
3,669,342 A 6/1972 Funkhouser
3,747,835 A 7/1973 Graser
3,767,042 A 10/1973 Ganz
3,963,121 A 6/1976 Kipp
4,010,593 A 3/1977 Graham
4,017,017 A * 4/1977 Vos ..... B65D 5/008 229/101
4,022,372 A * 5/1977 Graser ..... B65D 5/48036 206/193
4,063,679 A * 12/1977 Henry ..... B65D 5/029 229/108.1
4,101,069 A 7/1978 Wood
D250,748 S 1/1979 Leger
4,202,446 A 5/1980 Sutherland
4,260,097 A * 4/1981 Nold ..... B65D 5/029 229/108
4,328,893 A 5/1982 Oliff et al.
4,394,903 A 7/1983 Bakx
4,424,901 A 1/1984 Lanier
4,440,340 A 4/1984 Bakx
4,566,593 A 1/1986 Muller
4,691,858 A * 9/1987 Peer, Jr. ..... B65D 5/065 222/529
4,747,487 A 5/1988 Wood
4,804,089 A 2/1989 Wilson
4,875,585 A 10/1989 Kadleck et al.
4,901,849 A 2/1990 Wilson
4,910,913 A * 3/1990 Streeter ..... A01G 9/026 229/108
4,919,266 A 4/1990 McIntosh et al.
4,966,324 A 10/1990 Steel
4,972,991 A 11/1990 Schuster
5,000,313 A 3/1991 Oliff
5,042,660 A 8/1991 Carver
5,060,792 A 10/1991 Oliff
5,098,014 A * 3/1992 Perkins ..... B65D 5/46112 229/116
5,131,588 A 7/1992 Oliff
5,180,100 A 1/1993 Shimizu
5,195,676 A 3/1993 LeBras
5,246,112 A 9/1993 Stout et al.
5,297,673 A 3/1994 Sutherland
5,328,030 A 7/1994 Sutherland
5,351,878 A 10/1994 Cooper
5,421,458 A 6/1995 Campbell
5,427,241 A 6/1995 Sutherland
5,472,090 A 12/1995 Sutherland
5,472,138 A 12/1995 Ingram
5,485,915 A 1/1996 Harris
5,505,372 A 4/1996 Edson et al.
5,542,536 A 8/1996 Sutherland
5,551,556 A 9/1996 Sutherland
5,558,212 A 9/1996 Sutherland
5,558,213 A 9/1996 Sutherland
5,597,071 A 1/1997 Sutherland
5,609,251 A 3/1997 Harris
5,664,401 A 9/1997 Portrait et al.
5,682,995 A 11/1997 Sutherland
5,692,614 A 12/1997 Harris
5,704,470 A 1/1998 Sutherland
5,778,630 A 7/1998 Portrait et al.
5,853,088 A 12/1998 Saulas et al.
5,855,318 A 1/1999 Baxter
5,931,300 A 8/1999 Sutherland
5,937,620 A 8/1999 Chalendar
5,941,453 A 8/1999 Oliff
5,943,847 A 8/1999 Chalendar
5,947,367 A 9/1999 Miller et al.
5,975,286 A 11/1999 Oliff
6,019,220 A 2/2000 Sutherland
6,021,898 A 2/2000 Sutherland
6,021,899 A 2/2000 Sutherland
D425,436 S 5/2000 Wei
6,109,438 A 8/2000 Sutherland
6,155,480 A 12/2000 Botsford et al.
6,158,586 A 12/2000 Muller
D436,859 S 1/2001 Botsford
6,206,279 B1 * 3/2001 Countee ..... B65D 5/0005 229/117.27
6,227,367 B1 5/2001 Harrelson et al.
6,289,651 B1 9/2001 Le Bras
6,315,123 B1 11/2001 Ikeda
D470,769 S 2/2003 Holthaus
6,550,616 B2 4/2003 Le Bras
D489,609 S 5/2004 Holthaus
6,811,525 B2 11/2004 Culpepper
D502,097 S 2/2005 Holthaus
6,866,185 B2 3/2005 Harrelson
6,929,171 B1 * 8/2005 Thiersch ..... B65D 5/029 229/108
6,948,651 B2 9/2005 Ikeda
D511,248 S 11/2005 Premper
6,981,631 B2 1/2006 Fogle et al.
6,988,617 B2 1/2006 Gomes et al.
7,007,800 B2 3/2006 Le Bras
7,159,759 B2 1/2007 Sutherland
7,448,492 B2 11/2008 Sutherland
7,762,397 B2 7/2010 Coltri-Johnson et al.
D660,143 S 5/2012 Stowe
D684,042 S 6/2013 Betzig
8,479,972 B2 * 7/2013 Craft ..... B65D 5/029 229/101
8,997,987 B1 4/2015 Block
D737,137 S 8/2015 Exner
D805,895 S 12/2017 Smalley et al.
2003/0000182 A1 1/2003 Portrait et al.
2003/0132130 A1 7/2003 Bras
2004/0011674 A1 1/2004 Theelen
2004/0089671 A1 5/2004 Miller
2004/0188277 A1 9/2004 Auclair
2004/0188301 A1 9/2004 Gomes
2004/0243277 A1 12/2004 Bonnain et al.
2004/0254666 A1 12/2004 Bonnain et al.
2005/0001020 A1 1/2005 Gamier
2005/0178791 A1 8/2005 Miller
2005/0194430 A1 9/2005 Auclair et al.
2006/0191811 A1 8/2006 Fogle et al.
2006/0255108 A1 11/2006 Shmagin
2007/0069002 A1 3/2007 Gomes et al.
2007/0102498 A1 5/2007 Doll et al.
2007/0138242 A1 * 6/2007 Fitzwater ..... B65D 5/029 229/116.1
2007/0164093 A1 7/2007 Spivey, Sr.
2010/0012711 A1 * 1/2010 Paulen ..... B65D 5/029 229/248
2010/0025455 A1 * 2/2010 Pan ..... B65D 5/029 229/111
2010/0147933 A1 6/2010 Blin
2011/0113733 A1 * 5/2011 Franic ..... B65D 5/029 53/452
2013/0181042 A1 7/2013 Conradi

(56) References Cited

U.S. PATENT DOCUMENTS

| | | | | |
|---|---|---|---|---|
| 2016/0114933 | A1 | 4/2016 | Smalley | |
| 2018/0050836 | A1* | 2/2018 | Shafer | B65D 5/029 |

FOREIGN PATENT DOCUMENTS

| | | |
|---|---|---|
| DE | 91 04 905.9 | 6/1991 |
| DE | 92 03 858.1 | 5/1992 |
| EP | 0 459 658 | 12/1991 |
| EP | 0 473 266 A1 | 3/1992 |
| EP | 0 509 749 | 10/1992 |
| EP | 0 520 411 | 12/1992 |
| FR | 2 698 074 | 5/1994 |
| JP | 2003-95243 | 4/2003 |
| WO | WO 97/27124 | 7/1997 |
| WO | WO 02/102208 | 12/2002 |
| WO | WO 03/008292 | 1/2003 |
| WO | WO 2005/042370 | 12/2005 |

OTHER PUBLICATIONS

Office Action for Canadian Application No. 3,038,133 dated Feb. 25, 2020.

Supplementary European Search Report for EP 17 86 7897 dated Apr. 2, 2020.

* cited by examiner

CARTON WITH ASYMMETRICAL CORNERS

CROSS-REFERENCE TO RELATED APPLICATION

This application claims the benefit of U.S. Provisional Patent Application No. 62/416,231, filed on Nov. 2, 2016.

INCORPORATION BY REFERENCE

The disclosures of U.S. Provisional Patent Application No. 62/416,231, filed on Nov. 2, 2016, and U.S. Design patent application Ser. No. 29/583,072, filed on Nov. 2, 2016, are hereby incorporated by reference for all purposes as if presented herein in their entirety.

BACKGROUND OF THE DISCLOSURE

The present disclosure generally relates to cartons, associated blanks for forming cartons, and methods associated therewith. More specifically, the present disclosure relates to cartons, associated blanks for forming cartons, and associated methods with regard to blanks and cartons that have one or more asymmetrically-configured corner features.

SUMMARY OF THE DISCLOSURE

According to one aspect of the disclosure, a carton for holding at least one article comprises a plurality of panels that extends at least partially around an interior of the carton and a plurality of end flaps respectively foldably connected to a respective panel of the plurality of panels for closing at least one closed end of the carton. The carton comprises at least one asymmetrical corner extending between a top of the carton and a bottom of the carton and that transitions between a first configuration at one of the top and the bottom of the carton and a second configuration at the other of the top and the bottom of the carton.

According to another aspect of the disclosure, a blank for forming a carton for holding at least one article comprises a plurality of panels for extending at least partially around an interior of the carton formed from the blank and a plurality of end flaps respectively foldably connected to a respective panel of the plurality of panels for closing at least one closed end of the carton formed from the blank. The blank further comprises at least one corner section for forming at least one asymmetrical corner extending between a top of the carton formed from the blank and a bottom of the carton formed from the blank. The at least one asymmetrical corner transitions between a first configuration at one of the top and the bottom of the carton formed from the blank and a second configuration at the other of the top and the bottom of the carton formed from the blank.

According to another aspect of the disclosure, a method of forming a carton for holding at least one article comprises obtaining a blank comprising a plurality of panels, a plurality of end flaps respectively foldably connected to a respective panel of the plurality of panels, and at least one corner section. The method further comprises folding the plurality of panels to at least partially extend around an interior of the carton and folding the at least one corner section to form at least one asymmetrical corner extending between a top of the carton and a bottom of the carton and that transitions between a first configuration at one of the top and the bottom of the carton and a second configuration at the other of the top and the bottom of the carton. The method further comprises folding the plurality of end flaps to form at least one closed end of the carton.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans or glass bottles) as disposed within the carton embodiments. In this specification, the terms "lower," "bottom," "upper," and "top" indicate orientations determined in relation to fully erected and upright cartons. As described herein, cartons may be formed from blanks by overlapping multiple panels and/or end flaps. Such panels and/or end flaps may be designated herein in terms relative to one another, e.g., "first", "second", "third", etc., in sequential or non-sequential reference, without departing from the disclosure.

Figure 1:
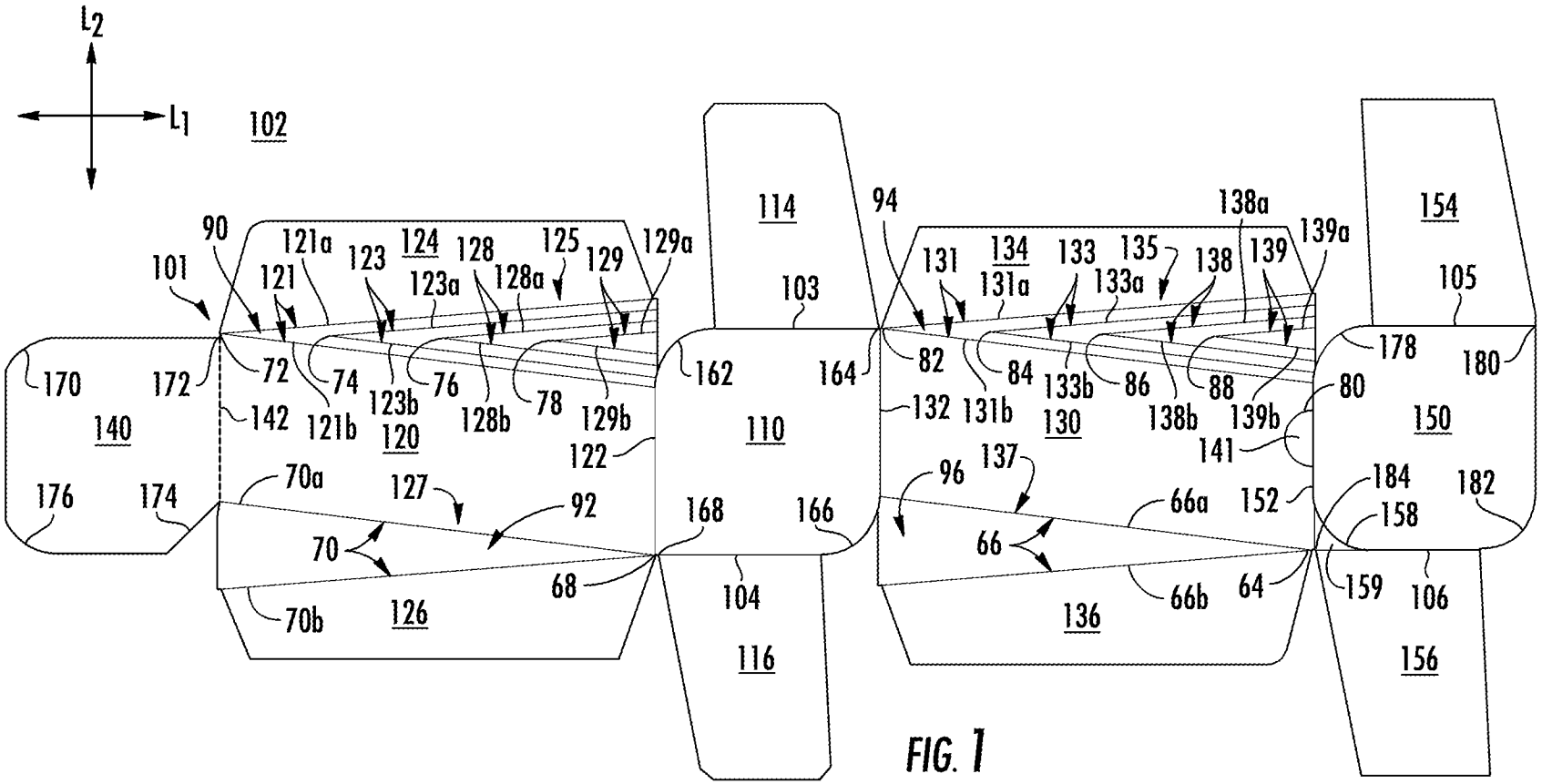
FIG. 1 is a plan view of a blank for forming a carton according to a first exemplary embodiment of the disclosure.

FIG. 1 is a plan view of an exterior side 101 of a blank 102 that has been obtained for forming a carton 100 (FIG. 3) according to a first exemplary embodiment of the present disclosure. The carton 100 is for holding a plurality of articles A (FIG. 2), such as bottles or cans, and the carton 100 is configured with one or more corners having an asymmetrical configuration, as described further herein.

The illustrated blank 102 has a longitudinal axis L1 and a lateral axis L2. As shown in FIG. 1, the blank 102 includes a bottom panel 110 foldably connected to a first side panel 120 at a lateral side thereof at a lateral fold line 122. The blank 102 includes a second side panel 130 foldably connected to an opposite lateral side of the bottom panel 110 at a lateral fold line 132. A first or inner top panel 140 is foldably connected to the first side panel 120 at a lateral fold line 142, and a second or outer top panel 150 is foldably connected to the second side panel 130 at a lateral fold line 152.

As shown, a first end flap 114 and a second end flap 116 are each foldably connected to the bottom panel 110, a first end flap 124 and a second end flap 126 are each foldably connected to the first side panel 120, a first end flap 134 and a second end flap 136 are each foldably connected to the second side panel 130, and a first end flap 154 and a second end flap 156 are each foldably connected to the outer top panel 150. When the carton 100 (FIG. 3) is erected, the end flaps 114, 124, 134, 154 close a first end 107 (FIG. 3) of the carton 100, and the end flaps 116, 126, 136, 156 close a second end 109 (FIG. 3) of the carton 100. In accordance with alternative embodiments of the present disclosure, different flap arrangements, for example, including one or more locking features, can be used for at least partially closing the ends 107, 109 of the carton 100.

In the illustrated embodiment, the end flaps 114, 124, 134, 154 generally extend along a first marginal area of the blank 102, the end flaps 116, 126, 136, 156 generally extend along a second marginal area of the blank 102. As shown, the end flaps 114 and 116 are foldably connected to the bottom panel 110 at respective longitudinal fold lines 103, 104, and the end flaps 154, 156 are foldably connected to the outer top panel 150 at respective longitudinal fold lines 105, 106. Fold lines as described herein may be, for example, substantially straight or offset at one or more locations to account for blank thickness and other factors.

Figure 5:
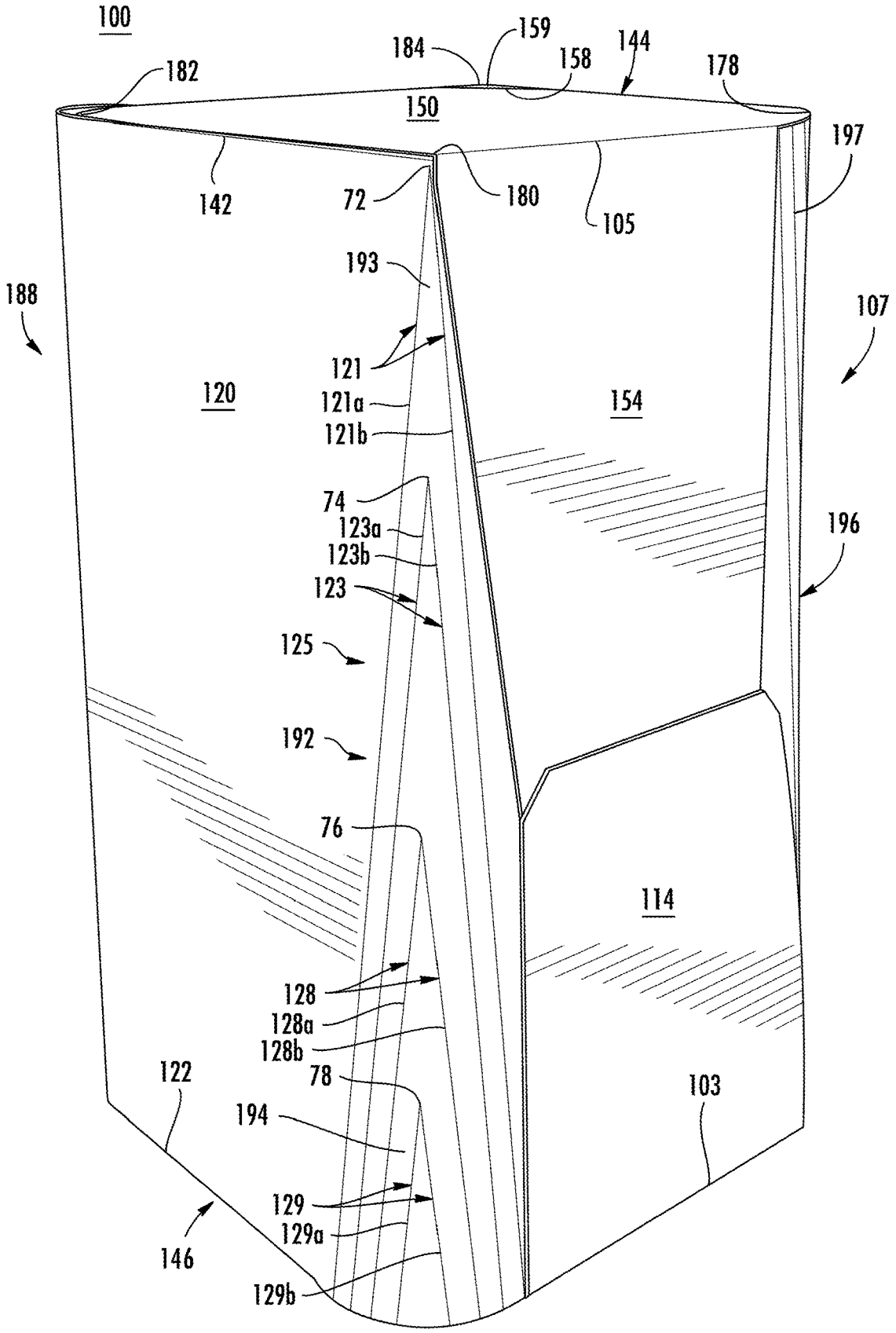
FIG. 5 is another perspective view of the carton of FIG. 3.

Still referring to FIG. 1, the end flap 124 is foldably connected to the first side panel 120 at a plurality of fold lines 125. As shown, the plurality of fold lines 125 includes a series of nested but longitudinally spaced apart V-shaped fold lines 121, 123, 128, 129 each having a respective vertex 72, 74, 76, 78 pointed away from the bottom panel 110. As shown, the V-shaped fold line 121 includes oblique fold lines 121*a*, 121*b* intersecting at the vertex 72, the V-shaped fold line 123 includes oblique fold lines 123*a*, 123*b* intersecting at the vertex 74, the V-shaped fold line 128 includes oblique fold lines 128*a*, 128*b* intersecting at the vertex 76, and the V-shaped fold line 129 includes oblique fold lines 129*a*, 129*b* intersecting at the vertex 78. As described further herein, the plurality of fold lines 125 facilitates formation of a corner feature or corner 192 of the carton 100 (FIG. 5). In particular, the outermost V-shaped fold line 121 may define a corner section 90 of the blank 102 for forming a corner 192 of the carton 100. As shown, the corner section 90 is foldably connected to the first side panel 120 at the oblique fold line 121*b* and the corner section 90 is foldably connected to the end flap 124 at the oblique fold line 121*a*.

Figure 4:
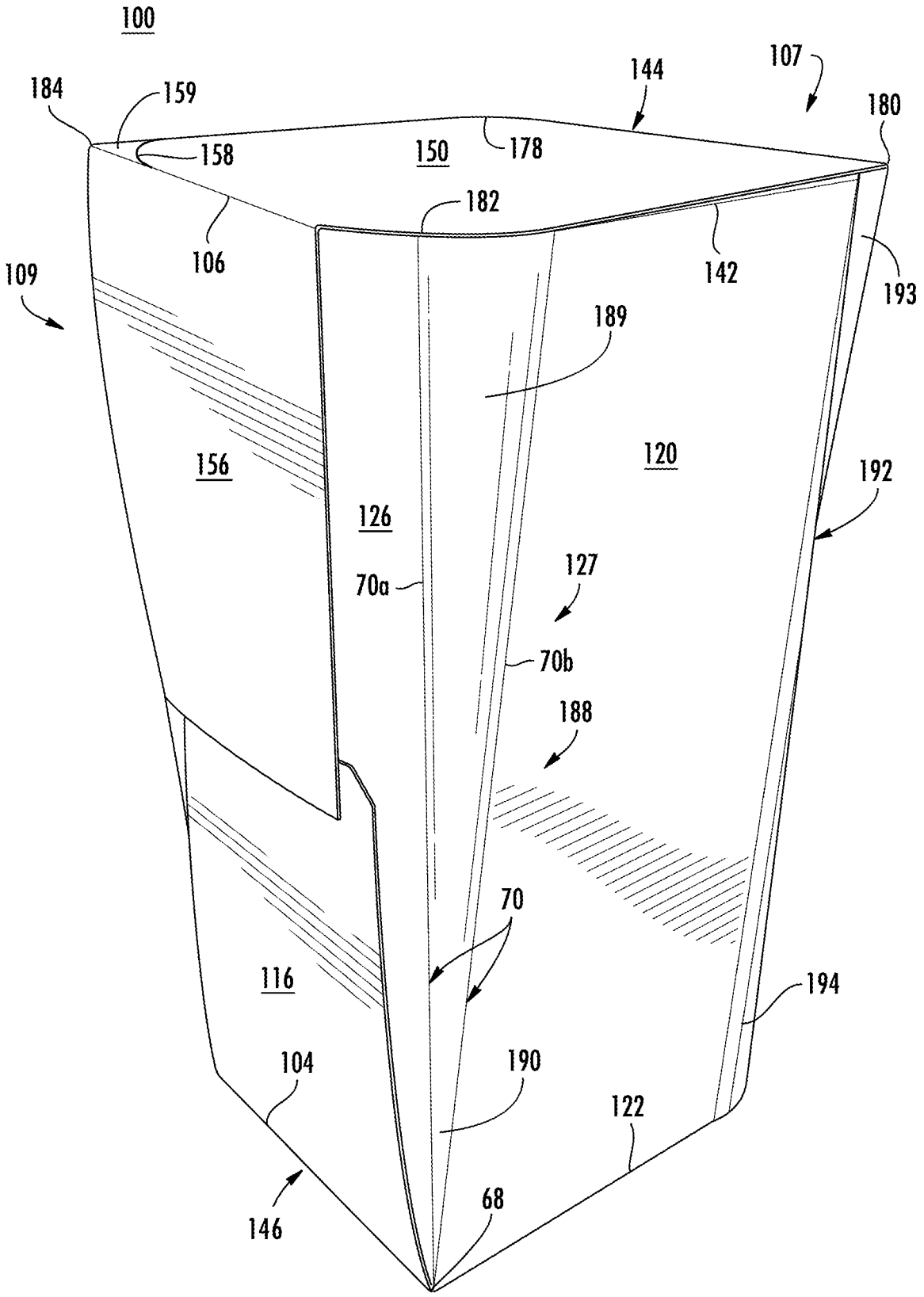
FIG. 4 is another perspective view of the carton of FIG. 3.

The end flap 126 is also foldably connected to the first side panel 120 at a plurality of fold lines 127. As shown, the plurality of fold lines 127 includes oblique fold lines 70*a*, 70*b* arranged as a V-shaped fold line 70 and intersecting at a vertex 68 pointed toward the bottom panel 110. In this regard, the plurality of fold lines 127 may include a different, e.g., fewer, number of fold lines than the plurality of fold lines 125 without departing from the disclosure. In other embodiments, the plurality of fold lines 127 may include a similar or greater number of fold lines than the plurality of fold lines 125. As described further herein, the plurality of fold lines 127 facilitates formation of a corner feature or corner 188 of the carton 100 (FIG. 4). In particular, the plurality of fold lines 127 may define a corner section 92 of the blank 102 for forming the corner 188 of the carton 100. As shown, the corner section 92 is foldably connected to the first side panel 120 at the oblique fold line 70*a* and the corner section 92 is foldably connected to the end flap 126 at the oblique fold line 70*b*.

Figure 6:
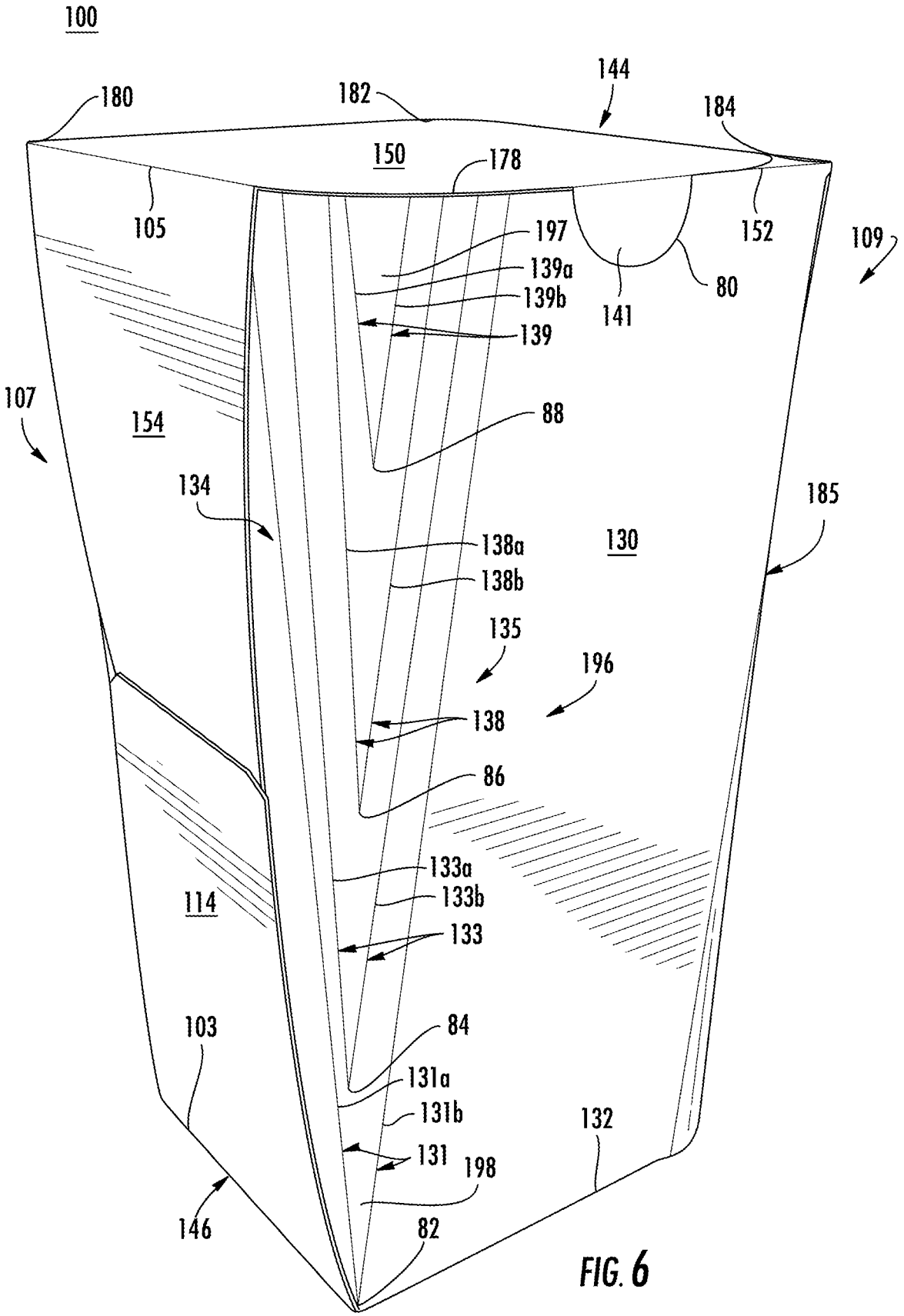
FIG. 6 is another perspective view of the carton of FIG. 3.

With continued reference to FIG. 1, the end flap 134 is foldably connected to the second side panel 130 at a plurality of fold lines 135. As shown, the plurality of fold lines 135 includes a series of nested V-shaped fold lines 131 133, 138, 139 each having a respective vertex 82, 84, 86, 88 pointed toward the bottom panel 110. As shown, the V-shaped fold line 131 includes oblique fold lines 131*a*, 131*b* intersecting at the vertex 82, the V-shaped fold line 133 includes oblique fold lines 133*a*, 133*b* intersecting at the vertex 84, the V-shaped fold line 138 includes oblique fold lines 138*a*, 138*b* intersecting at the vertex 86, and the V-shaped fold line 139 includes oblique fold lines 139*a*, 139*b* intersecting at the vertex 88. As described further herein, the plurality of fold lines 135 facilitates formation of a corner feature or corner 196 of the carton 100 (FIG. 6). In particular, the outermost V-shaped fold line 131 may define a corner section 94 of the blank 102 for forming the corner 196 of the carton 100. As shown, the corner section 94 is foldably connected to the second side panel 130 at the oblique fold line 131*b* and the corner section 94 is foldably connected to the end flap 134 at the oblique fold line 131*a*.

Figure 3:
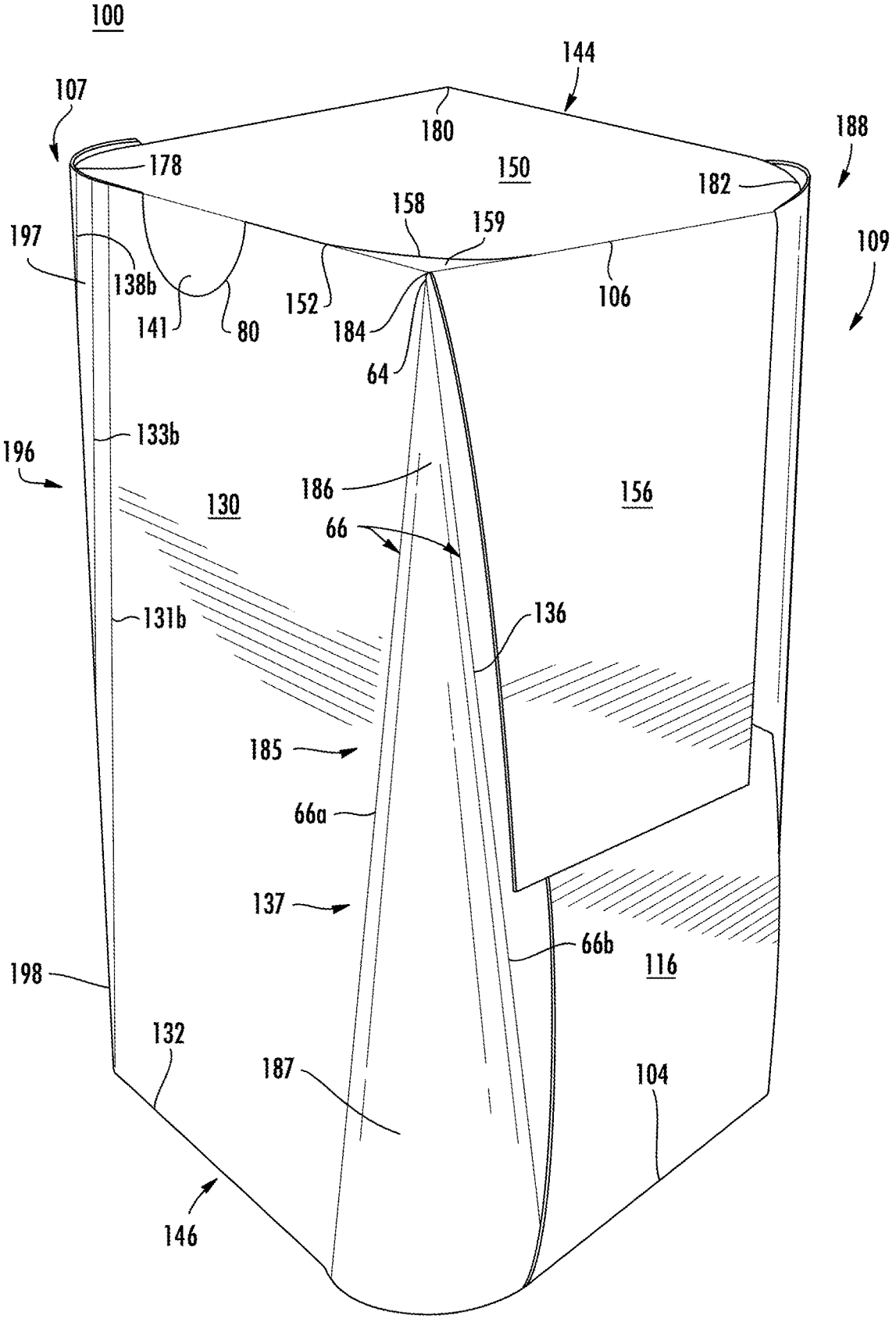
FIG. 3 is a perspective view of a carton formed from the blank of FIG. 1 according to the first exemplary embodiment.

The end flap 136 is also foldably connected to second side panel 130 at a plurality of fold lines 137. As shown, the plurality of fold lines 137 includes oblique fold lines 66*a*, 66*b* arranged as a single V-shaped fold line 66 and with a vertex 64 pointed toward the outer top panel 150, as described further herein. In this regard, the plurality of fold lines 137 may include a different, e.g., fewer, number of fold lines than the plurality of fold lines 135 without departing from the disclosure. In other embodiments, the plurality of fold lines 137 may include a similar or greater number of fold lines than the plurality of fold lines 135. As described further herein, the plurality of fold lines 137 facilitates formation of a corner feature or corner 185 of the carton 100 (FIG. 3). In particular, the plurality of fold lines 137 may define a corner section 96 of the blank 102 for forming the corner 185 of the carton 100. As shown, the corner section 96 is foldably connected to the second side panel 130 at the oblique fold line 66*a* and the corner section 96 is foldably connected to the end flap 136 at the oblique fold line 66*b*.

The second side panel 130 may also include a dispenser tab 141, as shown. The dispenser tab 141 may be a section of second side panel 130 that is at least partially defined by, for example, a cut line, tear line, or perforation, such as tear line 80, so that that the dispenser tab 141 may be separated from the second side panel 130 to define an aperture into an interior 108 (FIG. 2) of the carton 100 (FIG. 3) formed from the blank 102. The dispenser tab 141 may be foldably connected to the outer top panel 150 at a portion of the fold line 152, as shown, so that the dispenser tab 141 may be pressed inwardly or pulled outwardly while still being foldably connected to a portion of the blank 102. In embodiments, the dispenser tab 141 may be fully separable from the blank 102. The dispenser tab 141 may provide a region for manual engagement for a user, for example, to tear one or both of the outer top panel 150 and the inner top panel 140 from the remainder of the carton 100 to access the interior (FIG. 2) of the carton 100.

The bottom panel 110, as shown is a generally four-sided section of the blank 102 that includes corner portions 162, 164, 166, and 168. The corner portions 162 and 166 have a generally curved, e.g., rounded, configuration, while the corner portions 164 and 168 have a generally square, e.g., perpendicular or orthogonal, configuration. In this regard, diagonally opposite corner portions 162, 166 and 164, 168 have generally similar configurations. As shown, the corner portion 164 substantially intersects the vertex 82 of the V-shaped fold line 131 and the corner portion 168 substantially intersects the vertex 68 of the V-shaped fold line 70.

Similarly, the inner top panel 140 is a generally four-sided section of the blank 102 that includes corner portions 170, 172, 174, and 176. The corner portions 170 and 176 have a generally curved, e.g., rounded, configuration, while the corner portion 172 has a generally square configuration and the corner portion 174 has a generally chamfered, e.g., diagonal, configuration. As shown, the corner portion 172 substantially intersects the vertex 72 of the V-shaped fold line 121.

The outer top panel 150 is also a generally four-sided section of the blank 102 that includes the corner portions 178, 180, 182, and 184. The corner portions 178 and 182 have a generally curved, e.g., rounded, configuration, while the corner portions 180 and 184 have a generally square, e.g., perpendicular or orthogonal, configuration. In this regard, diagonally opposite corner portions 178, 182 and 180, 184 have generally similar configurations. As shown, the corner portion 184 substantially intersects the vertex 64 of the V-shaped fold line 66. A tear line 158 may also be formed along an interior portion of the outer top panel 150 near the corner portion 184. The tear line 158 may connect to one or more of fold lines 152, 106 to facilitate separation of a portion of the outer top panel 150 from the remainder of the blank 102. In this regard, a portion 159 of the outer top panel 150 may be positioned between the corner portion 184 and the tear line 158. The portion 159 may serve as a joint or bridge between the second side panel 130 and the end flap 156 in the event that another portion of the outer top panel 150 is removed.

As shown, the bottom panel 110 and the outer top panel 150 have irregularly-configured lateral edges such that the end flaps 114, 116 and 154, 156 may be offset from the longitudinal centerlines of the bottom panel 110 and the outer top panel 150. For example, the fold lines 103, 104 that foldably connect the end flaps 114, 116 to the bottom panel 110 may terminate before the respective curved corner portions 162, 166. Similarly, the fold lines 105, 106 that foldably connect end flaps 154, 156 to the outer top panel 150 may terminate before the respective curved corner portions 178, 182.

Figure 2:
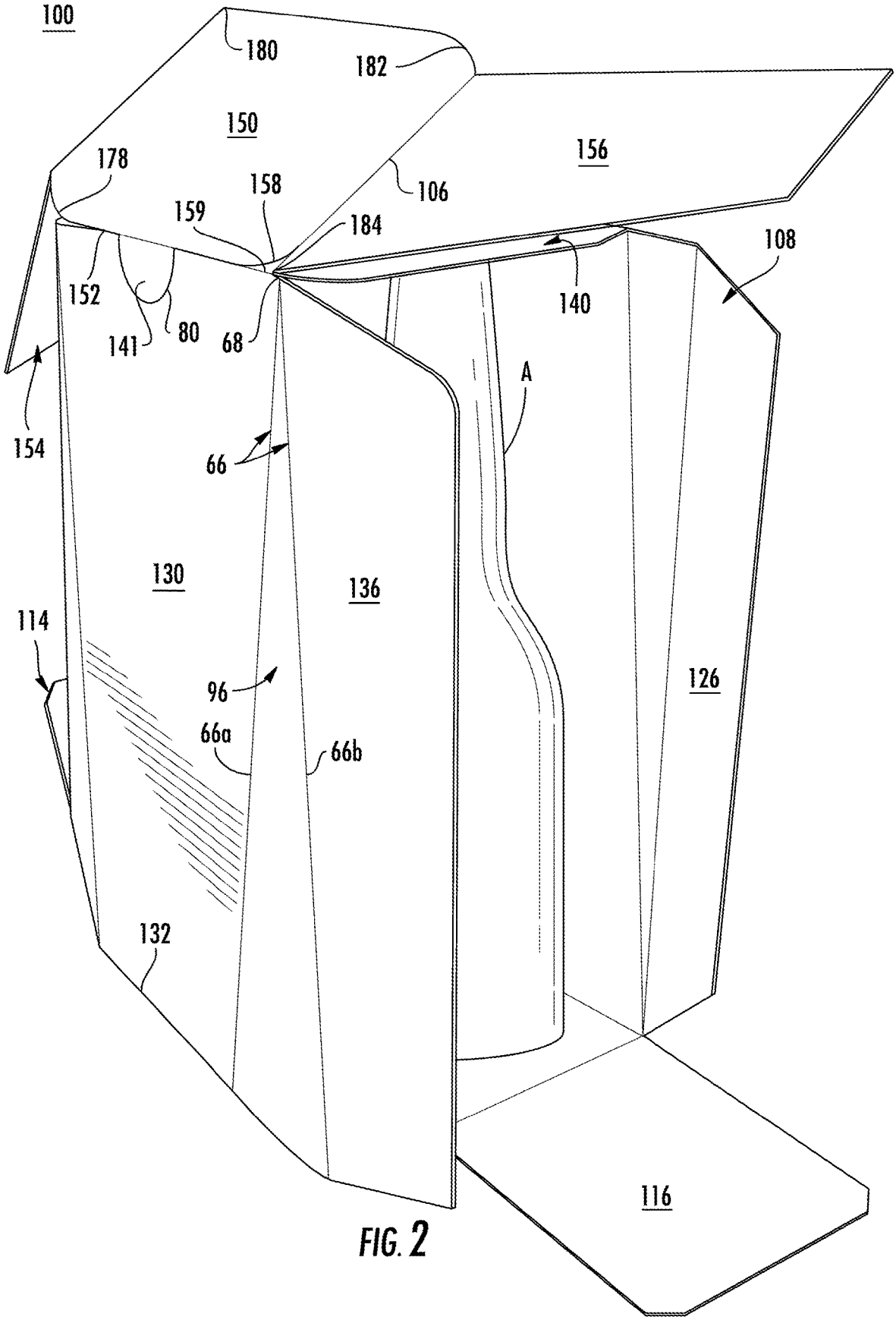
FIG. 2 is a perspective view of a partially-assembled carton formed from the blank of FIG. 1 according to the first exemplary embodiment.

With continued reference to FIG. 1, and referring additionally to FIG. 2, a partial assembly of the carton 100 (FIG. 2) formed from the blank 102 is illustrated. Such an assembly may be accomplished by an exemplary method that may include folding the bottom panel 110, the first side panel 120, the second side panel 130, the inner top panel 140, and the outer top panel 150 relative to one another at the fold lines 122, 132, 142, 152 around an interior 108 of the carton 100 to form an open-ended sleeve as shown, with the outer top panel 150 being at a top 144 of the carton 100 and the bottom panel 110 at a bottom 146 of the carton 100. In the configuration shown, the outer top panel 150 is overlapped upon the inner top panel 140 in at least partial face-to-face contact to form a top wall of the carton 100. The outer top panel 150 and the inner top panel 140 may be joined, for example, with an adhesive. In embodiments, the outer top panel 150 and the inner top panel 140 may be joined in another fashion, for example, with one or more interlocking features.

As shown, one or more articles A may be inserted into the interior 108 of carton 100 (FIG. 3) prior to the closure of one or both of the ends 107, 109 (FIG. 3). It will be understood that that the carton 100 may be sized and shaped to hold articles A in a single layer, more than one layer, and/or in different row/column arrangements (e.g., 1×6, 2×2, 2×4, 3×4, 3×6, 3×5×2, 2×6, 5×6, 2×6×2, 3×4×2, 2×9, etc.) without departing from the disclosure.

Still referring to FIG. 1, and referring additionally to FIGS. 3-6, an exemplary embodiment of the carton 100 formed from the blank 102 is illustrated. The carton 100 may be fully assembled from the sleeve illustrated in FIG. 2 by folding the end flaps 124, 126 relative to the first side panel 120, folding the end flaps 134, 136 relative to the second side panel 130, and folding the end flaps 114, 116 and 154, 156 relative to the bottom panel 110 and the outer top panel 150, respectively, such that the end flaps 114, 154 overlap the folded end flaps 124, 126 in at least partial face-to-face contact and the end flaps 116, 156 overlap the folded end flaps 126, 136 in at least partial face-to-face contact. The resulting carton 100, as shown, defines a first closed end 107 opposite a second closed end 109 laterally disposed between the first and second side panels 120, 130 and longitudinally between the bottom panel 110 and the top panels 140, 150. The closed ends 107, 109 may be secured, for example, with an adhesive or through mechanical joining such as with a tab-and-slot arrangement. In embodiments, the assembly steps described above may be performed in a different order without departing from the disclosure.

Carton 100, as shown, defines the carton corners 185, 188, 192, 196 extending between the bottom panel 110 and top panels 140, 150 such that the carton corners 185, 188, 192, 196 each extend between a top 144 and a bottom 146 of the carton 100. The carton corner 185 extends between the second side panel 130 and the closed end 109, the carton corner 188 extends between the first side panel 120 and the closed end 109, the carton corner 192 extends between the first side panel 120 and the closed end 107, and the carton corner 196 extends between the second side panel 130 and the closed end 107. The carton corners 185, 188, 192, 196, as shown, can be referred to as asymmetrical corners that have a variable, e.g., asymmetrical, configuration along their length such that carton corners 185, 188, 192, 196 transition between a first, square configuration, e.g., having a perpendicular, orthogonal, or otherwise edged configuration, and a second, curved configuration, e.g., having a curved, rounded, or arcuate configuration, along one or more portions thereof. As described herein, a square configuration may be a first or second configuration and a curved configuration may be the other of a first or second configuration. As also described herein, the respective corner portions 178, 180, 182, 184 of the outer top panel 150 and the respective corner portions 164, 162, 168, 166 of the bottom panel 110 have a complementary or similar configuration to the respective carton corners 196, 192, 188, 185. Curvature of portions of the carton corners 196, 192, 188, 185 may be facilitated by the presence of curved portions of articles A in the interior 108 (FIG. 2) of the carton 100.

In this regard, the carton corner 185, extending from the square corner portion 184 of the outer top panel 150 to the curved corner portion 166 of the bottom panel 110, transitions between a square configuration near or adjacent the square corner portion 184 of the outer top panel 150 and a curved configuration near or adjacent the curved corner portion 166 of the bottom panel 110. Such a transition is facilitated by the configuration of the plurality of fold lines 137 extending between the second side panel 130 and the end flap 136. In particular, the vertex 64 of the plurality of fold lines 137 near the square corner portion 184 of the outer top panel 150 urges the end flap 136 to bend along one of the plurality of fold lines 137 to produce a square portion 186 of the carton corner 185 near or adjacent the square corner portion 184 of the outer top panel 150 and the gap between the plurality of fold lines 137 near or adjacent the curved corner portion 166 of bottom panel 110 urges the end flap 136 to bend between the plurality of fold lines 137 to produce a curved portion 187 of the carton corner 185 near or adjacent the curved corner portion 166 of bottom panel 110.

As shown, the carton corner 188, extending from the curved corner portion 182 of the outer top panel 150 to the square corner portion 168 of the bottom panel 110, transitions between a curved configuration near or adjacent the curved corner portion 182 of the outer top panel 150 and a square configuration near or adjacent the square corner portion 168 of the bottom panel 110. Such a transition is facilitated by the configuration of the plurality of fold lines 127 extending between the first side panel 120 and the end flap 126. In particular, the gap between the plurality of fold lines 127 near the curved corner portion 182 of the outer top panel 150 urges the end flap 126 to bend between the plurality of fold lines 127 to produce a curved portion 189 of the carton corner 188 near or adjacent the curved corner portion 182 of outer top panel 150, and the vertex 68 of the plurality of fold lines 127 near the square corner portion 168 of bottom panel 110 urges the end flap 126 to bend along one of the plurality of fold lines 127 to produce a square portion 190 of the carton corner 188 near or adjacent the square corner portion 168 of the bottom panel 110.

As shown, the carton corner 192, extending from the square corner portion 180 of the outer top panel 150 to the curved corner portion 162 of the bottom panel 110, transitions between a square configuration near or adjacent the square corner portion 180 of the outer top panel 150 and a curved configuration near or adjacent the curved corner portion 162 of the bottom panel 110. Such a transition is facilitated by the configuration of the plurality of fold lines 125 extending between the first side panel 120 and the end flap 124. In particular, the vertices 72, 74, 76, 78 of the plurality of fold lines 125 near or adjacent the square corner portion 180 of the outer top panel 150 urges the end flap 124 to bend along one of the plurality of fold lines 125 to produce a square portion 193 of the carton corner 192 near or adjacent the square corner portion 180 of the outer top panel 150 and the gap between the plurality of fold lines 125 near or adjacent the curved corner portion 162 of bottom panel 110 urges the end flap 124 to bend between the plurality of fold lines 125 to produce a curved portion 194 of the carton corner 192 near or adjacent the curved corner portion 162 of the bottom panel 110.

As shown, the carton corner 196, extending from the curved corner portion 178 of the outer top panel 150 to the square corner portion 164 of the bottom panel 110, transitions between a curved configuration near or adjacent the curved corner portion 178 of the outer top panel 150 and a square configuration near or adjacent the square corner portion 164 of the bottom panel 110. Such a transition is facilitated by the configuration of the plurality of fold lines 135 extending between the second side panel 130 and the end flap 134. In particular, the gap between the plurality of fold lines 135 near or adjacent the curved corner portion 178 of the outer top panel 150 urges the end flap 134 to bend between the plurality of fold lines 135 to produce a curved portion 197 of the carton corner 196 near or adjacent the curved corner portion 178 of outer top panel 150, and the vertices 82, 84, 86, 88 of the plurality of fold lines 135 near or adjacent the square corner portion 164 of the bottom panel 110 urges the end flap 134 to bend along one of the plurality of fold lines 135 to produce a square portion 198 of the carton corner 196 near or adjacent the square corner portion 164 of the bottom panel 110.

The configuration of the carton corners 185, 188, 192, 196 allows the carton 100 to have more tightly packed articles A (FIG. 2), as the grouping of articles A tightens when pushed inward at the curved portions 187, 189, 194, 197. In this regard, the presence of the curved portions 187, 189, 194, 197 may reduce what would otherwise be empty space in the interior 108 (FIG. 2) of the carton 100. At the same time, the presence of the square portions 186, 190, 193, 198 allows a degree of movement of articles A such that articles A may be more tightly packed into the interior 108 (FIG. 2) of the carton 100 than into a carton having uniform square or orthogonal corners, but while still providing clearance among the articles A, for example, to permit a degree of shifting and/or redistribution during shipping or other movement.

Further, the differently-configured carton corners 185, 188, 192, 196 can be provided such that the carton 100 can be optionally oriented in a nesting or otherwise closely-engaging relationship with a corner or other recess, for example, of an outer container, having either a curved or square configuration.

Additionally, indicia or other visual configurations of the exterior of carton 100 may be arranged differently on or near the curved portions 187, 189, 194, 197 or the square portions 186, 190, 193, 198 so that indicia or other visual configurations of the carton 100 appear differently based on the consumer's point of view. For example, the carton 100 is provided with the corners 185, 188, 192, 196 that, when viewed in sequence around the perimeter of the carton 100, have alternating configurations, e.g., starting with the corner 185 and proceeding along the second end 109, a consumer would view, looking from the top to the bottom of the carton 100, a square-to-curved corner (corner 185), a curved-to-square corner (corner 188), a square-to-curved corner (corner 192), and a curved-to-square corner (corner 196). Such an alternating configuration may provide a break or disruption in visual perception on the part of the consumer that presents an enhanced opportunity to display indicia disposed on an exterior surface of the carton 100. As another example, when multiple cartons 100 are arranged and/or stacked near each other, the alternating configuration of the carton corners 185, 188, 192, 196 as described above may sufficiently minimize visual uniformity of the cartons 100 to entice and/or allow additional viewing of the surface area of one or more cartons 100 by the user.

Figure 7:
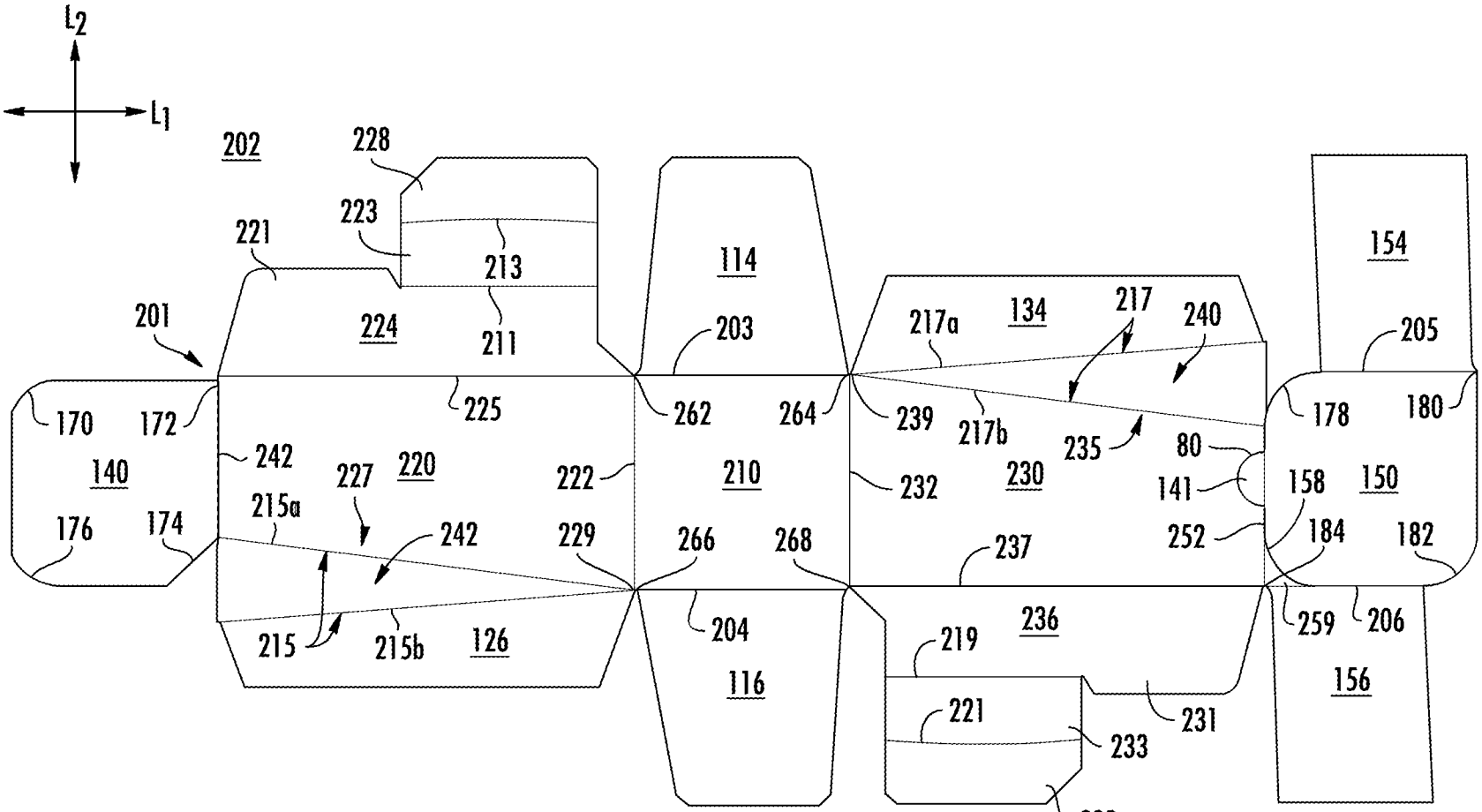
FIG. 7 is a perspective view of a blank for forming a carton according to a second exemplary embodiment of the disclosure.

FIG. 7 is a plan view of an exterior side 201 of a blank 202 that has been obtained for forming a carton 200 (FIG. 9) according to a second exemplary embodiment of the present disclosure. The blank 202 and the carton 200 may have similar features to the blank 102 (FIG. 1) and the carton 100 (FIG. 3) described above, and like or similar reference numbers are used to indicate like or similar features between the various embodiments. The carton 200 is for holding a plurality of articles A (FIG. 8), and the carton 200 is configured with one or more corners having an asymmetrical configuration, as described further herein.

The blank 202 has the longitudinal axis L1 and the lateral axis L2. As shown in FIG. 7, the blank 202 includes a bottom panel 210 foldably connected to a first side panel 220 at a lateral side thereof at a lateral fold line 222. The blank 202 includes a second side panel 230 foldably connected to an opposite lateral side of the bottom panel 210 at a lateral fold line 232. The first or inner top panel 140 is foldably connected to the first side panel 220 at a lateral fold line 242, and the outer or second top panel 150 is foldably connected to the second side panel 230 at a lateral fold line 252.

As shown, the first end flap 114 and the second end flap 116 are each foldably connected to the bottom panel 210, a first end flap 224 and the second end flap 126 are each foldably connected to the first side panel 220, the first end flap 134 and a second end flap 136 are each foldably connected to the second side panel 230, and the first end flap 154 and the second end flap 156 are each foldably connected to the outer top panel 150. When the carton 200 (FIG. 3) is erected, the end flaps 114, 224, 134, 154 close a first end 207 (FIG. 9) of the carton 100, and the end flaps 116, 126, 236, 156 close a second end 209 (FIG. 9) of the carton 200. In accordance with alternative embodiments of the present disclosure, different flap arrangements, for example, including one or more locking features, can be used for at least partially closing the ends 207, 209 of the carton 200.

In the illustrated embodiment, the end flaps 114, 224, 134, 154 generally extend along a first marginal area of the blank 202, and the end flaps 116, 126, 236, 156 generally extend along a second marginal area of the blank 202. As shown, the end flaps 114 and 116 are foldably connected to the bottom panel 210 at respective longitudinal fold lines 203, 204 and the end flaps 154, 156 are foldably connected to the outer top panel 150 at respective longitudinal fold lines 205, 206.

Still referring to FIG. 7, the end flap 224 is foldably connected to the first side panel 220 at a longitudinal fold line 225. The end flap 224 includes a main portion 221, a proximal extension 223 foldably connected to the main portion 221 at a longitudinal fold line 211, and a distal extension 228 foldably connected to the proximal extension 223 at a longitudinal fold line 213.

Figure 10:
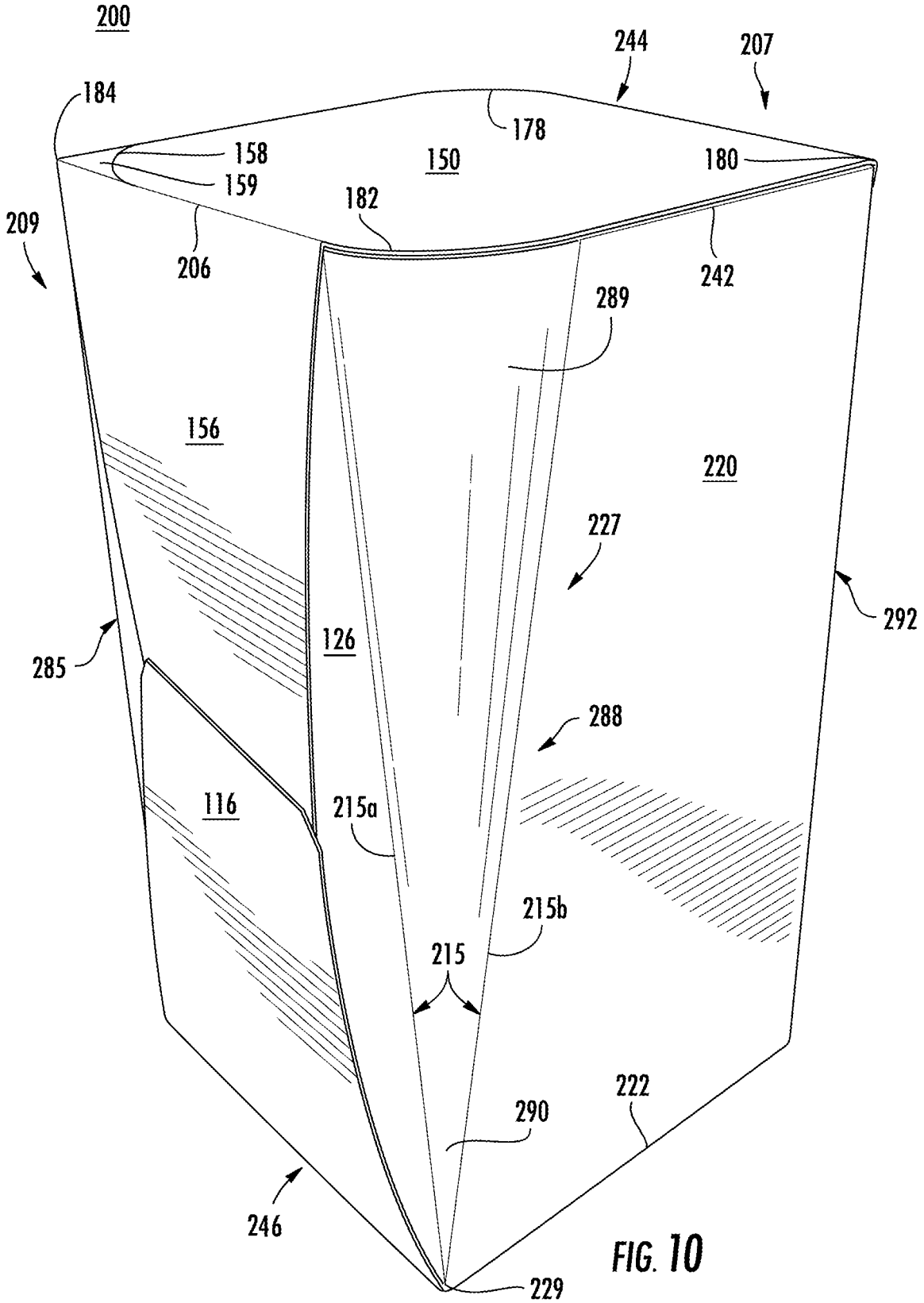
FIG. 10 is another perspective view of the carton of FIG. 9.
Figure 11:
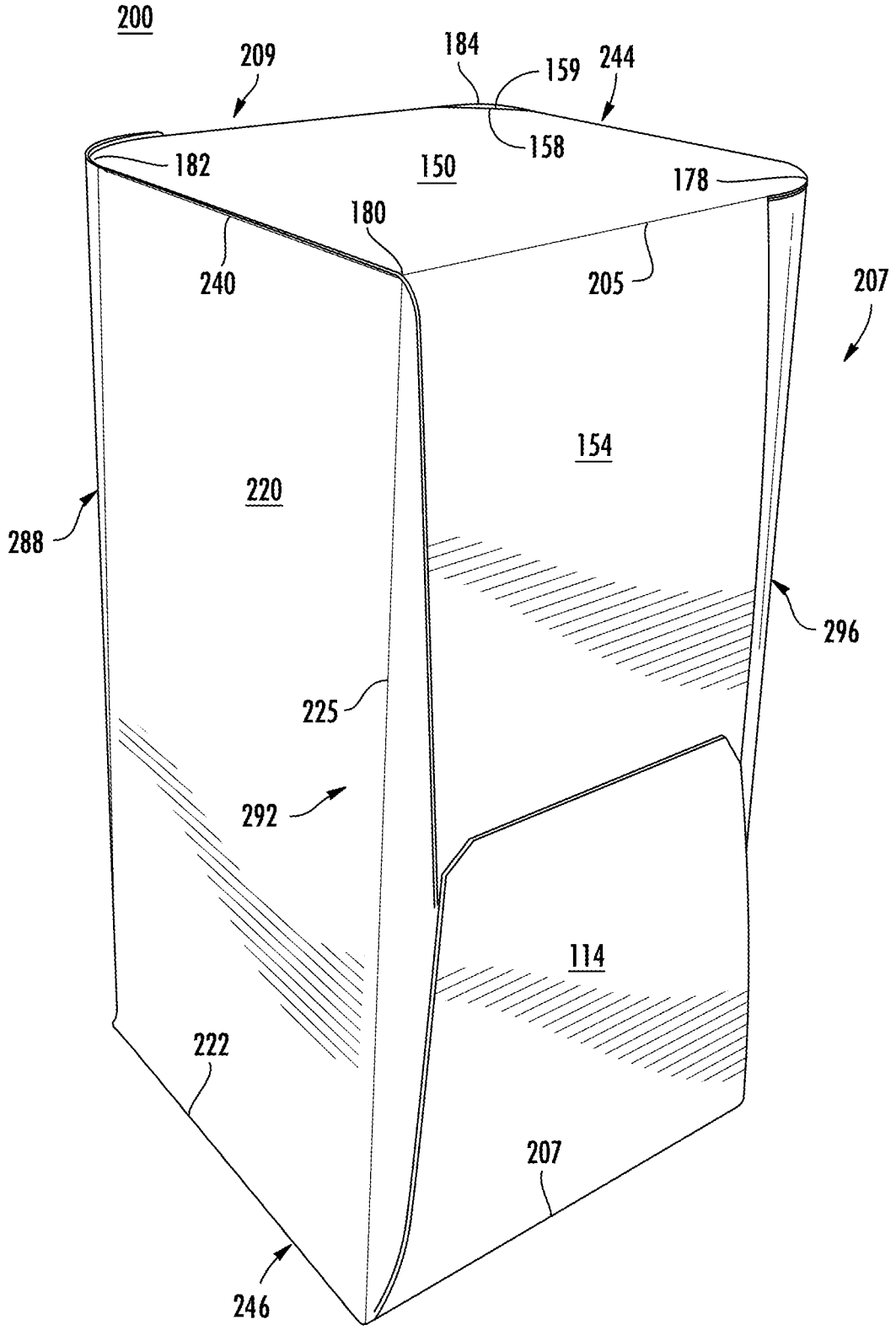
FIG. 11 is another perspective view of the carton of FIG. 9.

The end flap 126, as shown, is foldably connected to the first side panel 220 with a plurality of fold lines 227. As shown, the plurality of fold lines 227 includes oblique fold lines 215*a*, 215*b* intersecting at a vertex 229 pointed toward the bottom panel 210 to form a V-shaped fold line 215. As described further herein, the plurality of fold lines 227 facilitates formation of a corner feature or corner 288 of the carton 200 (FIG. 10). In particular, the V-shaped fold line 215 may define a corner section 242 of the blank 202 for forming a corner 288 of the carton 200. As shown, the corner section 242 is foldably connected to the first side panel 220 at the oblique fold line 215*a* and the corner section 242 is foldably connected to the end flap 126 at the oblique fold line 215*b*.

Figure 12:
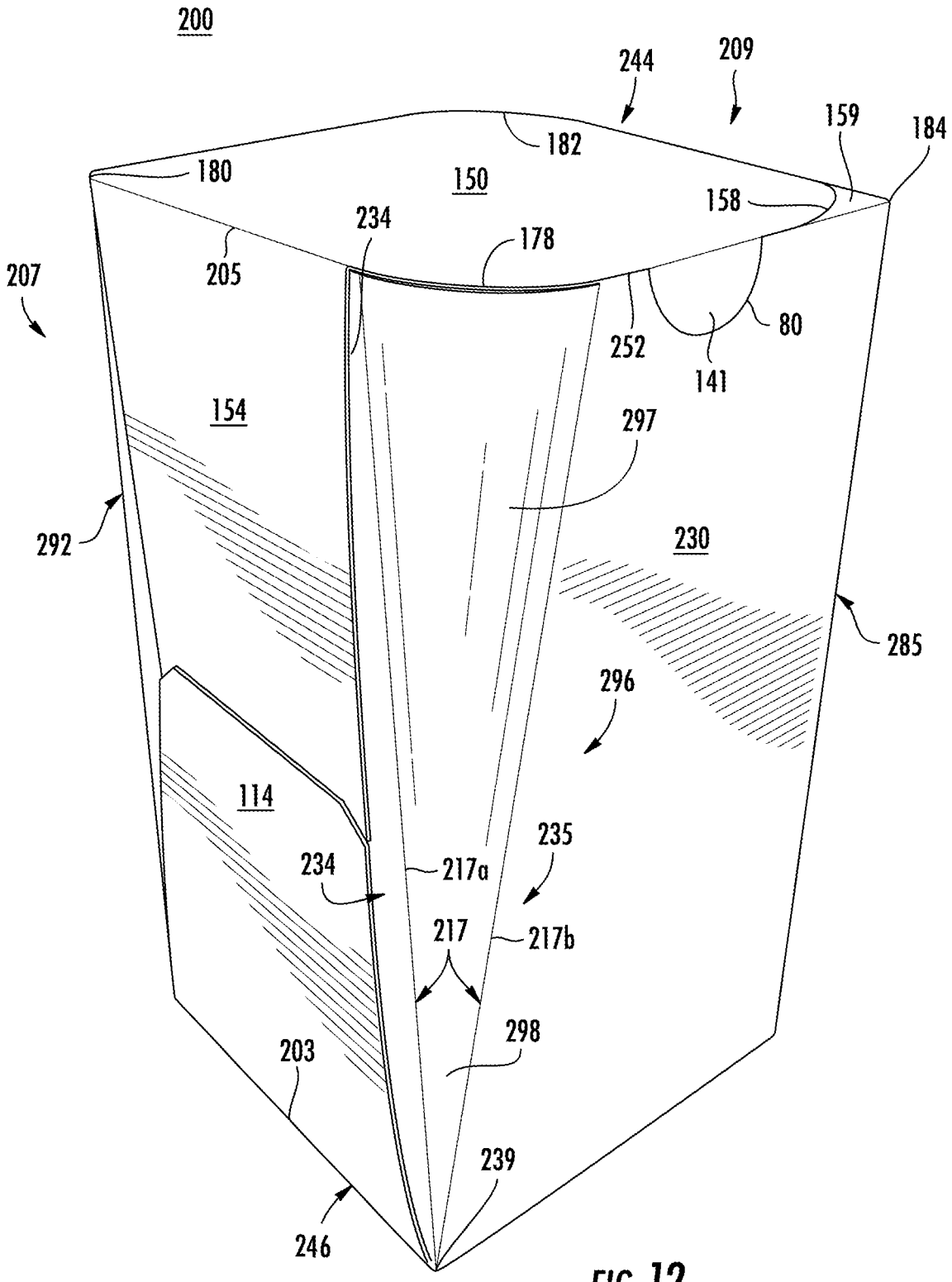
FIG. 12 is another perspective view of the carton of FIG. 9.

With continued reference to FIG. 7, the end flap 134 is foldably connected to the second side panel 230 with a plurality of fold lines 235. As shown, the plurality of fold lines 235 includes oblique fold lines 217*a*, 217*b* arranged as a V-shaped fold line 217 with a vertex 239 pointed toward bottom panel 210. As shown, the V-shaped fold line 217 includes oblique fold lines 217*a*, 217*b* intersecting at the vertex 239. As described further herein, the plurality of fold lines 217 facilitates the formation of a corner feature or corner 296 of the carton 200 (FIG. 12). In particular, the V-shaped fold line 217 may define a corner section 240 of the blank 202 for forming the corner 296 of the carton 200. As shown, the corner section 240 is foldably connected to the second side panel 230 at the oblique fold line 217*b* and the corner section 230 is foldably connected to the end flap 134 at the oblique fold line 217*a*.

Still referring to FIG. 7, the end flap 236 is foldably connected to the second side panel 230 at a longitudinal fold line 237. The end flap 236, as shown, includes a main portion 231, a proximal extension 233 foldably connected to the main portion 231 at a longitudinal fold line 219, and a distal extension 238 foldably connected to the proximal extension 233 at a longitudinal fold line 221.

The bottom panel 210, as shown, is a generally four-sided section of the blank 202 that includes corner portions 262, 264, 266, and 268 each having a generally square, e.g., perpendicular or orthogonal, configuration. As shown, the corner portion 266 substantially intersects the vertex 229 and the corner portion 264 substantially intersects the vertex 239.

Figure 8:
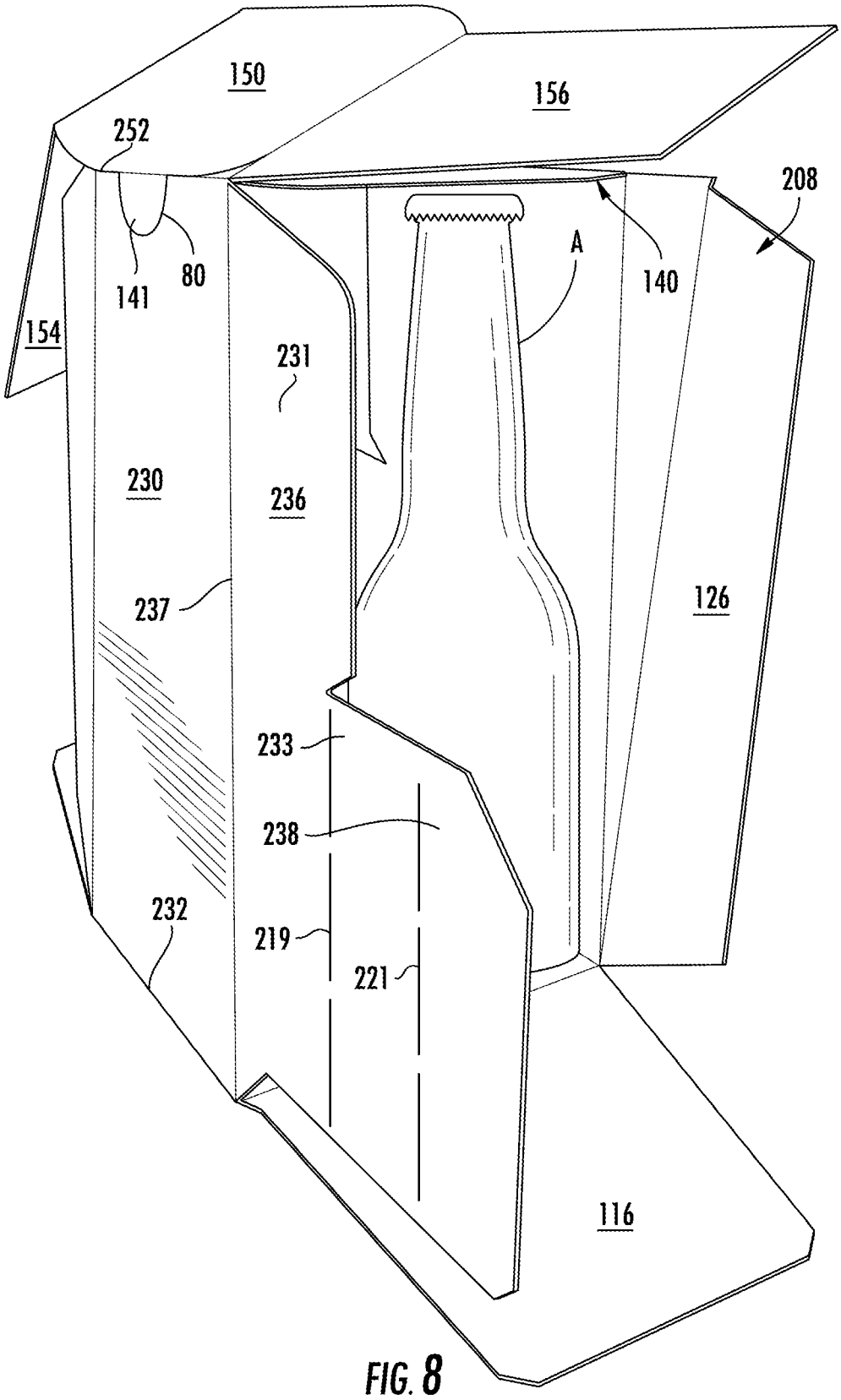
FIG. 8 is a perspective view of a partially-assembled carton formed from the blank of FIG. 7 according to the second exemplary embodiment.
Figure 9:
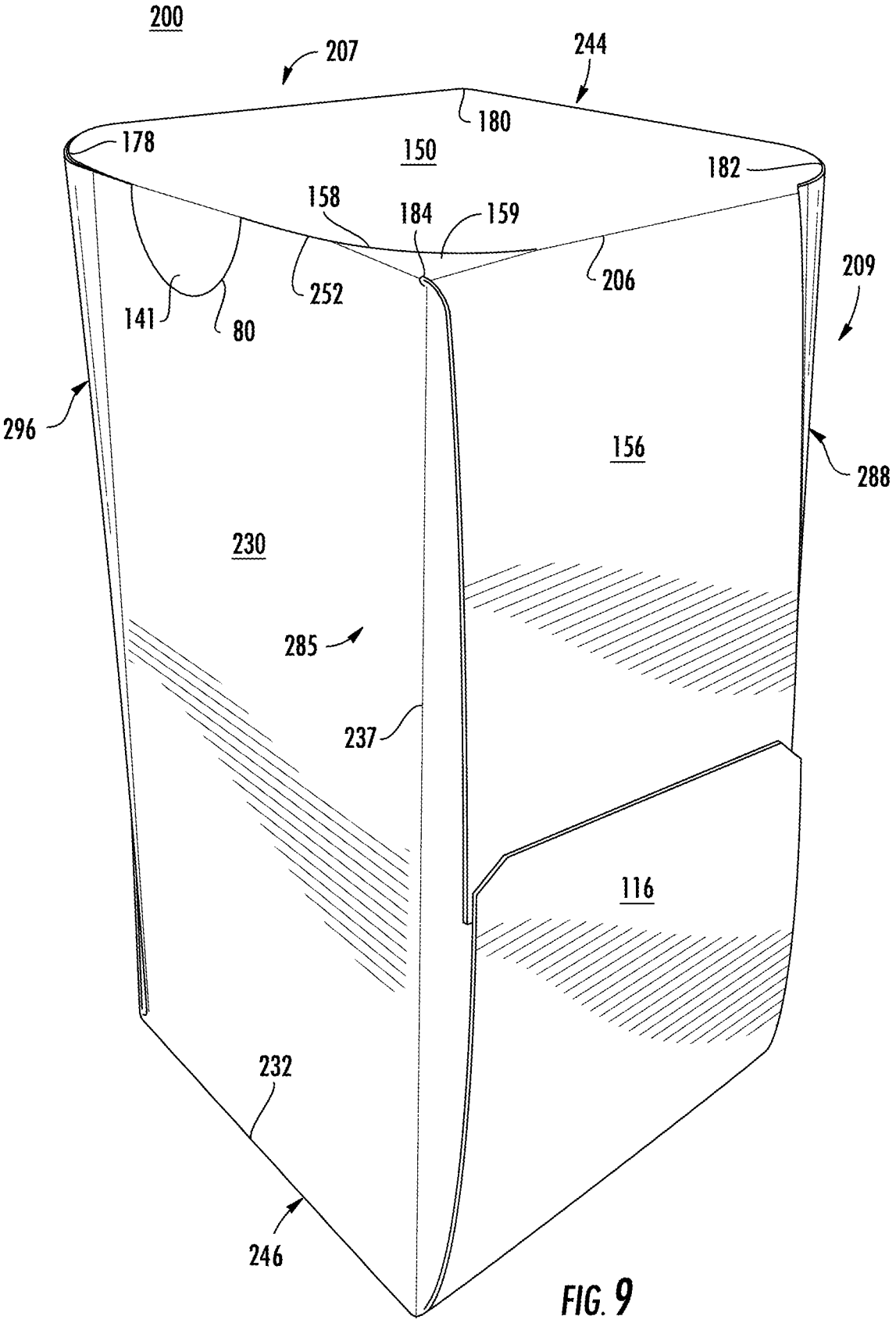
FIG. 9 is a perspective view of a carton formed from the blank of FIG. 7 according to the second exemplary embodiment.

With continued reference to FIG. 7, and referring additionally to FIG. 8, a partial assembly of the carton 200 (FIG. 9) formed from the blank 202 is illustrated. Such an assembly may be accomplished by an exemplary method that may include folding the bottom panel 210, the first side panel 220, the second side panel 230, the inner top panel 140, and the outer top panel 150 relative to one another at the fold lines 222, 232, 242, 252 to form an open-ended sleeve as shown, with the outer top panel 150 at a top 244 of the carton 200 and the bottom panel 210 at a bottom 246 of the carton 200. In the configuration shown, the outer top panel 150 is overlapped upon the inner top panel 140 in at least partial face-to-face contact to form a top wall of the carton 200. The outer top panel 150 and inner top panel 140 may be joined, for example, with an adhesive. In embodiments, the outer top panel 150 and the inner top panel 140 may be joined in another fashion, for example, with one or more interlocking features.

As shown, one or more articles A may be inserted into the interior 208 of the carton 200 (FIG. 3) prior to the closure of one or both ends 207, 209. It will be understood that that the carton 200 may be sized and shaped to hold articles A in a single layer, more than one layer, and/or in different row/column arrangements (e.g., 1×6, 2×2, 2×4, 3×4, 3×6, 3×5×2, 2×6, 5×6, 2×6×2, 3×4×2, 2×9, etc.) without departing from the disclosure.

Still referring to FIG. 7, and referring additionally to FIGS. 9-12, an exemplary embodiment of the carton 200 formed from the blank 202 is illustrated. The carton 200 may be fully assembled from the sleeve illustrated in FIG. 8 by folding the end flaps 224, 126 relative to the first side panel 220, folding the end flaps 134, 236 relative to the second side panel 230, and folding the end flaps 114, 116 and 154, 156 relative to the bottom panel 210 and the outer top panel 150, respectively, such that the end flaps 114, 154 overlap the folded end flaps 224, 126 in at least partial face-to-face contact and the end flaps 116, 156 overlap the folded end flaps 126, 236 in at least partial face-to-face contact. The resulting carton 200, as shown, defines a first closed end 207 opposite a second closed end 209 laterally disposed between first and second side panels 220, 230 and longitudinally between bottom panel 210 and top panels 140, 150. Closed ends 207, 209 may be secured, for example, with an adhesive or through mechanical joining such as with a tab-and-slot arrangement.

In the course of closing ends 207, 209, the proximal and distal extensions 223, 228 of end flap 224 and the proximal and distal extensions 233, 238 of the end flap 236 can be folded inwardly into the interior 208 (FIG. 8) of carton 200 to engage the articles A. For example, the distal extension 228 can be folded about the fold line 213, and the proximal extension 223 can be folded about the fold line 211. In this regard, the proximal and distal extensions 223, 228 extend inwardly into the interior 208 of the carton 200 near the corner portion 262 of the bottom panel 210 to engage the articles A, e.g., to help secure the articles A in the carton 200, to help cushion the articles A in the carton 200, and/or to reinforce one or more portions of the carton 200. Similarly, the distal extension 238 can be folded into the interior 208 (FIG. 9) of the carton 200 about the fold line 221, and the proximal extension 233 can be folded about the fold line 219. In this regard, the proximal and distal extensions 233, 238 extend inwardly into the interior 208 (FIG. 9) of the carton 200 near the corner portion 268 of the bottom panel 210 to engage the articles A.

In embodiments, the assembly steps described above may be performed in a different order.

Carton 200, as shown, defines the carton corners 285, 288, 292, 296 extending between the bottom panel 210 and the top panels 140, 150 such that the carton corners 285, 288, 292, 296 each extend from the top 244 of the carton 200 to the bottom 246 of the carton 200. The carton corner 285 extends between the second side panel 230 and the closed end 209, the carton corner 188 extends between the first side panel 220 and the closed end 209, the carton corner 292 extends between the first side panel 220 and the closed end 207, and the carton corner 296 extends between the second side panel 230 and the closed end 207. At least the carton corners 288 and 296 have a variable, e.g., asymmetrical, configuration along their length such that the carton corners 288 and 296 transition between a square configuration and a curved configuration along one or more portions thereof transition between a square configuration, e.g., having a perpendicular, orthogonal, or otherwise edged configuration, and a curved configuration, e.g., having a curved, rounded, or arcuate configuration, along one or more portions thereof. As described herein, a square configuration may be a first or second configuration and a curved configuration may be the other of a first or second configuration. Further, at least the carton corners 285, 296 have a substantially unchanging or constant, e.g., symmetrical, configuration along their length. As described herein, the respective corner portions 178, 180, 182, 184 of the outer top panel 150 and the respective corner portions 264, 262, 266, 268 of the bottom panel 110 have a complementary or similar configuration to the respective carton corners 296, 292, 288, 285.

In this regard, the carton corner 285, extending from the square corner portion 184 of the outer top panel 150 to the square corner portion 268 of the bottom panel 210, has a square configuration formed by the intersection of the square corner portion 184, the square corner portion 268, and the fold line 237.

As shown, the carton corner 288, extending from the curved corner portion 182 of the outer top panel 150 to the square corner portion 266 of the bottom panel 210, transitions between a curved configuration near or adjacent the curved corner portion 182 of the outer top panel 150 and a square configuration near or adjacent the square corner portion 266 of the bottom panel 210. Such a transition is facilitated by the configuration of the plurality of fold lines 227 extending between the first side panel 220 and the end flap 126. In particular, the gap between the plurality of fold lines 227 near or adjacent the curved corner portion 182 of outer top panel 150 urges the end flap 126 to bend between the plurality of fold lines 227 to produce a curved portion 289 of the carton corner 288 near or adjacent the curved corner portion 182 of the outer top panel 150, and the vertex 229 of the plurality of fold lines 227 near or adjacent the square corner portion 266 of the bottom panel 210 urges the end flap 126 to bend along one of the plurality of fold lines 227 to produce a square portion 290 of the carton corner 288 near or adjacent the square corner portion 266 of the bottom panel 210.

The carton corner 292 extending from the square corner portion 180 of the outer top panel 150 to the square corner portion 262 of the bottom panel 210, as shown, has a square configuration formed by the intersection of the square corner portion 180, the square corner portion 262, and the fold line 225.

As also shown, the carton corner 296, extending from the curved corner portion 178 of the outer top panel 150 to the square corner portion 264 of the bottom panel 210, transitions between a curved configuration near or adjacent the curved corner portion 178 of the outer top panel 150 and a square configuration near or adjacent the square corner portion 264 of the bottom panel 210. Such a transition is facilitated by the configuration of the plurality of fold lines 235 extending between the second side panel 230 and the end flap 234. In particular, the gap between the plurality of fold lines 235 near or adjacent the curved corner portion 178 of the outer top panel 150 urges the end flap 234 to bend between the plurality of fold lines 235 to produce a curved portion 297 of the carton corner 296 near or adjacent the curved corner portion 178 of the outer top panel 150, and the vertex 239 of the plurality of fold lines 235 near or adjacent the square corner portion 264 of the bottom panel 210 urges the end flap 234 to bend along one of the plurality of fold lines 235 to produce a square portion 298 of the carton corner 296 near or adjacent the square corner portion 264 of the bottom panel 210.

The configuration of the carton corners 285, 288, 292, 296 allow the carton 200 to have more tightly packed articles A (FIG. 8), as the grouping of articles A tightens when pushed inward at the curved portions 289, 297. In this regard, the presence of the curved portions 289, 297 may reduce what would otherwise be empty space in the interior (FIG. 8) of the carton 200. At the same time, the presence of the square portions 290, 298, and square corners 285, 292 allows a degree of movement of articles A such that articles A may be more tightly packed into the interior 208 (FIG. 8) of the carton 200 than into a carton having uniform square or orthogonal corners, but while still providing clearance among the articles A, for example, to permit a degree of shifting and/or redistribution during shipping or other movement.

Further, the differently-configured carton corners 285, 288, 292, 296 can be provided such that the carton 200 can be optionally oriented in a nesting or otherwise closely-engaging relationship with a corner or other recess, for example, of an outer container, having either a curved or square configuration.

Additionally, indicia or other visual configurations of the exterior of the carton 200 may be arranged differently on or near the curved portions 289, 297, square portions 290, 298, or square corners 285, 292 so that indicia or other visual configurations of the carton 200 appear differently based on the consumer's point of view. For example, the carton 200 is provided with the carton corners 285, 290, 292, 296 that, when viewed in sequence around the perimeter of the carton 200, have alternating configurations, e.g., starting with the carton corner 285 and proceeding along the second end 209, a consumer would view, looking from the top to the bottom of the carton 200, a square corner (corner 285), a curved-to-square corner (corner 288), a square corner (corner 292), and a curved-to-square corner (corner 296). Such an alternating configuration may provide a break or disruption in visual perception on the part of the consumer that presents an enhanced opportunity to display indicia disposed on an exterior surface of the carton 200. As another example, when multiple cartons 200 are arranged and/or stacked near each other, the alternating configuration of the carton corners 285, 288, 292, 296 as described above may sufficiently minimize visual uniformity of the cartons 200 to entice and/or allow additional viewing of the surface area of one or more cartons 200 by the user.

Any of the features of the various embodiments of the disclosure can be combined with, replaced by, or otherwise configured with other features of other embodiments of the disclosure without departing from the scope of this disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure carton panels or flaps in place.

In accordance with the above-described embodiments of the present disclosure, a fold line can be any substantially linear, although not necessarily straight, form of weakening that facilitates folding therealong. As described herein, fold lines can include straight, angled, and/or curved portions. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present, disclosure for each of the tear lines to be replaced with a continuous slit, or the like. For example, a cut line can be a continuous slit or could be wider than a slit without departing from the present disclosure.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels that extends at least partially around an interior of the carton;

a plurality of end flaps respectively foldably connected to a respective panel of the plurality of panels for closing at least one closed end of the carton, the carton comprises at least one asymmetrical corner extending between a top of the carton and a bottom of the carton and that transitions between a first configuration at one of the top and the bottom of the carton and a second configuration at the other of the top and the bottom of the carton, the first configuration is a curved configuration at one end of the top and the bottom of the carton and the second configuration is a square configuration at the other of the top and the bottom of the carton.

2. The carton of claim 1, wherein the carton comprises at least one symmetrical corner extending between the top of the carton and the bottom of the carton.

3. The carton of claim 2, wherein the at least one symmetrical corner comprises a square configuration.

4. The carton of claim 1, wherein the at least one asymmetrical corner comprises a plurality of fold lines.

5. The carton of claim 4, wherein the plurality of fold lines are arranged in at least one V-shaped configuration.

6. The carton of claim 5, wherein the at least one V-shaped configuration comprises a plurality of nested V-shaped configurations.

7. The carton of claim 1, wherein the plurality of panels comprises at least one top panel, at least one bottom panel, a first side panel, and a second side panel, and the at least one closed end of the carton comprises a first closed end opposite a second closed end, the first closed end and the second closed end are each disposed between the first side panel and the second side panel.

8. The carton of claim 7, wherein the at least one asymmetrical corner comprises a first asymmetrical corner between the first side panel and one of the first closed end and the second closed end and a second asymmetrical corner between the second side panel and one of the first closed end and the second closed end, and the carton comprises a first symmetrical corner between the first side panel and one of the first closed end and the second closed end and a second symmetrical corner between the second side panel and one of the first closed end and the second closed end.

9. The carton of claim 8, wherein the first configuration is a curved configuration and the second configuration is a square configuration, and each of the first symmetrical corner and the second symmetrical corner has a square configuration.

10. The carton of claim 1, wherein at least one panel of the plurality of panels comprises a dispenser tab defined by a tear line.

11. The carton of claim 10, wherein the plurality of panels comprises at least one top panel, and the dispenser tab is foldably connected to the at least one top panel.

12. The carton of claim 1, wherein at least one end flap of the plurality of end flaps comprises a main portion, a proximal extension foldably connected to the main portion, and a distal extension foldably connected to the main portion.

13. The carton of claim 12, wherein the proximal extension and the distal extension are positioned in the interior of the carton to engage the at least one article.

14. A carton for holding at least one article, the carton comprising:

a plurality of panels that extends at least partially around an interior of the carton;

a plurality of end flaps foldably connected to a respective panel of the plurality of panels for forming at least one closed end of the carton, the carton comprises at least one asymmetrical corner extending between a top of the carton and a bottom of the carton and that transitions between a first configuration at one of the top and the bottom of the carton and a second configuration at the other of the top and the bottom of the carton, the at least one symmetrical corner comprises a plurality of fold lines arranged in at least one V-shaped configuration, the at least one V-shaped configuration comprises a first oblique fold line intersecting a second oblique fold line at a vertex.

15. The carton of claim 14, wherein the at least one asymmetrical corner is formed from a corner section between at least one panel of the plurality of panels and at least one end flap of the plurality of end flaps, the corner section is foldably connected to the at least one panel at the first oblique fold line and the corner section is foldably connected to the at least one end flap at the second oblique fold line.

16. A carton for holding, at least one article, the carton comprising:

a plurality of panels that extends at least partially around an interior of the carton, the plurality of panels comprises at least one top panel, at least one bottom panel, a first side panel, and a second side panel;

a plurality of end flaps respectively foldably connected to a respective panel of the plurality of panels for forming a first closed end of the carton and a second closed end of the carton opposite the first closed end of the carton, the first closed end and the second closed end are each disposed between the first side panel and the second side panel, the carton comprises at least one asymmetrical corner extending between a top of the carton and a bottom of the carton and that transitions between a first configuration at one of the top and the bottom of the carton and a second configuration at the other of the top and the bottom of the carton, the at least one asymmetrical corner comprises a first asymmetrical corner between the first side panel and the first closed end, a second asymmetrical corner between the first side panel and the second closed end, a third asymmetrical corner between the second side panel and the first closed end, and a fourth asymmetrical corner between the second side panel and the second closed end.

17. The carton of claim 16, wherein the first configuration is a curved configuration and the second configuration is a square configuration.

18. The carton of claim 17, wherein at least one of the first asymmetrical corner, the second asymmetrical corner, the third asymmetrical corner, and the fourth asymmetrical corner has the respective first configuration adjacent the at least one top panel.

19. The carton of claim 18, wherein at least one of the first asymmetrical corner, the second asymmetrical corner, the third asymmetrical corner, and the fourth asymmetrical corner has the respective second configuration adjacent the at least one top panel.

20. A carton for holding at least one article, the carton comprising:

a plurality of panels that extends at least partially around an interior of the carton, the plurality of panels comprises at least one top panel, at least one bottom panel, a first side panel, and a second side panel;

a plurality of end flaps respectively foldably connected to a respective panel of the plurality of panels for forming a first closed end of the carton and a second closed end of the carton opposite the first closed end, the first closed end and the second closed end are each disposed between the first side panel and the second side panel, the carton comprises at least one asymmetrical corner extending between a top of the carton and a bottom of the carton and that transitions between a first configuration at one of the top and the bottom of the carton and a second configuration at the other of the top and the bottom of the carton, the at least one top panel comprises at least one corner portion adjacent the respective at least one asymmetrical corner, the at least one corner portion of the at least one top panel has a complementary configuration to one of the first configuration and the second configuration.

21. The carton of claim 20, wherein the at least one bottom panel comprises at least one corner portion adjacent the respective at least one asymmetrical corner, the at least one corner portion of the at least one bottom panel has a complementary configuration to the other of the first configuration and the second configuration.

22. A blank for forming a carton for holding at least one article, the blank comprising:

a plurality of panels for extending at least partially around an interior of the carton formed from the blank;

a plurality of end flaps respectively foldably connected to a respective panel of the plurality of panels for closing at least one closed end of the carton formed from the blank, at least one corner section for forming at least one asymmetrical corner extending between a top of the carton formed from the blank and a bottom of the carton formed from the blank, the at least one asymmetrical corner transitions between a first configuration at one of the top and the bottom of the carton formed from the blank and a second configuration at the other of the top and the bottom of the carton formed from the blank, the first configuration is a curved configuration at one of the top and the bottom of the carton and the second configuration is a square configuration at the other of the top and the bottom of the carton.

23. The blank of claim 22, wherein the at least one corner section is a first at least one corner section and the blank further comprises a second at least one corner section for forming at least one symmetrical corner extending between the top and the bottom of the carton formed from the blank.

24. The blank of claim 23, wherein the at least one symmetrical corner comprises a square configuration.

25. The blank of claim 22, wherein the at least one corner section comprises a plurality of fold lines.

26. The blank of claim 25, wherein the plurality of fold lines are arranged in at least one V-shaped configuration.

27. The blank of claim 26, wherein the at least one V-shaped configuration comprises a plurality of nested V-shaped configurations.

28. The blank of claim 22, wherein the plurality of panels comprises at least one top panel, at least one bottom panel, a first side panel, and a second side panel, and the at least one closed end of the carton formed from the blank comprises a first closed end opposite a second closed end, the first closed end and the second closed end are each disposed between the first side panel and the second side panel in the carton formed from the blank.

29. The blank of claim 28, wherein the at least one asymmetrical corner comprises a first asymmetrical corner between the first side panel and one of the first closed end and the second closed end in the carton formed from the blank and a second asymmetrical corner between the second side panel and one of the first closed end and the second closed end in the carton formed from the blank, the at least one corner section is a first at least one corner section, and the blank further comprises a second at least one corner section for forming at least one symmetrical corner in the carton formed from the blank, the at least one symmetrical corner section comprises a first symmetrical corner extending between the top and the bottom of the carton formed from the blank between the first side panel and one of the first closed end and the second closed end and a second symmetrical corner extending between the top and the bottom of the carton formed from the blank between the second side panel and one of the first closed end and the second closed end.

30. The blank of claim 29, wherein the first configuration is a curved configuration and the second configuration is a square configuration, and each of the first symmetrical corner and the second symmetrical corner has a square configuration in the carton formed from the blank.

31. The blank of claim 22, wherein at least one panel of the plurality of panels comprises a dispenser tab defined by a tear line.

32. The blank of claim 31, wherein the plurality of panels comprises at last one top panel, and the dispenser tab is foldably connected to the at least one top panel.

33. The blank of claim 22, wherein at least one end flap of the plurality of end flaps comprises a main portion, a proximal extension foldably connected to the main portion, and a distal extension foldably connected to the main portion.

34. The blank of claim 33, wherein the proximal extension and the distal extension are for being positioned in the interior of the carton formed from the blank to engage the at least one article.

35. A blank for forming a carton for holding at least one article, the blank comprising:

a plurality of panels for extending at least partially around an interior of the carton formed from the blank;

a plurality of end flaps respectively foldably connected to a respective panel of the plurality of panels for forming at least one closed end of the carton formed from the blank, at least one corner section for forming at least one asymmetrical corner extending between a top and a bottom of the carton formed from the blank, the at least one asymmetrical corner transitions between a first configuration at one of the top and the bottom of the carton formed from the blank and a second configuration at the other of the top and the bottom of the carton formed from the blank, the at least one corner section comprises a plurality of fold lines arranged in at least one V-shaped configuration, the at least one V-shaped configuration comprises a first oblique fold line intersecting a second oblique fold line at a vertex.

36. The blank of claim 35, wherein the at least one corner section is foldably connected to at least one panel of the plurality of panels at the first oblique fold line and the at least one corner section is foldably connected to at least one end flap of the plurality of end flaps at the second oblique fold line.

37. A blank for forming a carton for holding at least one article, the blank comprising:

a plurality of panels for extending at least partially around an interior of the carton formed from the blank, the plurality of panels comprises at least one top panel, at least one bottom panel, a first side panel, and a second side panel;

a plurality of end flaps respectively foldably connected to a respective panel of the plurality of panels for closing a first closed end of the carton formed from the blank and a second closed end opposite the first closed end of the carton formed from the blank, the first closed end and the second closed end are each disposed between the first side panel and the second side panel in the carton formed from the blank, at least one corner section for forming at least one asymmetrical corner extending between a top of the carton formed from the blank and a bottom of the carton formed from the blank, the at least one asymmetrical corner transitions between a first configuration at one of the top and the bottom of the carton formed from the blank and a second configuration at the other of the top and the bottom of the carton formed from the blank, the at least one asymmetrical corner comprises a first asymmetrical corner between the first side panel and the first closed end in the carton formed from the blank, a second asymmetrical corner between the first side panel and the second closed end in the carton formed from the blank, a third asymmetrical corner between the second side panel and the first closed end in the carton formed from the blank, and a fourth asymmetrical corner between the second side panel and the second closed end in the carton formed from the blank.

38. The blank of claim 37, wherein the first configuration is a curved configuration and the second configuration is a square configuration.

39. The blank of claim 38, wherein at least one of the first asymmetrical corner, the second asymmetrical corner, the third asymmetrical corner, and the fourth asymmetrical corner in the carton formed from the blank has the respective first configuration adjacent the at least one top panel.

40. The blank of claim 39, wherein at least one of the first asymmetrical corner, the second asymmetrical corner, the third asymmetrical corner, and the fourth asymmetrical corner in the carton formed from the blank has the respective second configuration adjacent the at least one top panel.

41. A blank for forming a carton for holding at least one article, the blank comprising:

a plurality of panels for extending at least partially around an interior of the carton formed from the blank, the plurality of panels comprises at least one top panel, at least one bottom panel, a first side panel, and a second side panel;

a plurality of end flaps respectively foldably connected to a respective panel of the plurality of panels for forming a first closed end of the carton formed from the blank and a second closed end of the carton formed from the blank opposite the first closed end of the carton formed from the blank, the first closed end and the second closed end are each disposed between the first side panel and the second side panel in the carton formed from the blank, at least one corner section for forming at least one asymmetrical corner extending between a top and a bottom of the carton formed from the blank, the at least one asymmetrical corner transitions between a first configuration at one of the top and the bottom of the carton formed from the blank and a second configuration at the other of the top and the bottom of the carton formed from the blank, the at least one top panel comprises at least one corner portion adjacent the respective at least one asymmetrical corner, the at least one corner portion of the at least one top panel has a complementary configuration to one of the first configuration and the second configuration.

42. The blank of claim 41, wherein the at least one bottom panel comprises at least one corner portion adjacent the respective at least one asymmetrical corner in the carton formed from the blank, the at least one corner portion of the at least one bottom panel has a complementary configuration to the other of the first configuration and the second configuration.

43. A method of forming a carton for holding at least one article, the method comprising:

obtaining a blank comprising a plurality of panels, a plurality of end flaps respectively foldably connected to a respective panel of the plurality of panels, and at least one corner section;

folding the plurality of panels to at least partially extend around an interior of the carton and folding the at least one corner section to form at least one asymmetrical corner extending between a top of the carton and a bottom of the carton and that transitions between a first configuration at one of the top and the bottom of the carton and a second configuration at the other of the top and the bottom of the carton, the first configuration is a curved configuration at one of the top and the bottom of the carton and the second configuration is a square configuration at the other of the top and the bottom of the carton; and folding the plurality of end flaps to form at least one closed end of the carton.

44. The method of claim 43, wherein the at least one corner section is a first at least one corner section and the blank further comprises a second at least one corner section, the folding the plurality of panels further comprises folding the second at least one corner section to form at least one symmetrical corner extending between the top and the bottom of the carton.

45. The method of claim 44, wherein the at least one symmetrical corner comprises a square configuration.

46. The method of claim 43, wherein the at least one corner section comprises a plurality of fold lines.

47. The method of claim 46, wherein the plurality of fold lines are arranged in at least one V-shaped configuration.

48. The method of claim 47, wherein the at least one V-shaped configuration comprises a plurality of nested V-shaped configurations.

49. The method of claim 43, wherein the plurality of panels comprises at least one top panel, at least one bottom panel, a first side panel, and a second side panel, and the at least one closed end of the carton comprises a first closed end opposite a second closed end, the first closed end and the second closed end are each disposed between the first side panel and the second side panel.

50. The method of claim 49, wherein the at least one asymmetrical corner comprises a first asymmetrical corner between the first side panel and one of the first closed end and the second closed end and a second asymmetrical corner between the second side panel and one of the first closed end and the second closed end, the at least one corner section is a first at least one corner section, and the blank further comprises a second at least one corner section, the folding the plurality of panels further comprises folding the second at least one corner section to form at least one symmetrical corner, at least one symmetrical corner comprises a first symmetrical corner between the first side panel and one of the first closed end and the second closed end and a second symmetrical corner between the second side panel and one of the first closed end and the second closed end.

51. The method of claim 50, wherein the first configuration is a curved configuration and the second configuration is a square configuration, and each of the first symmetrical corner and the second symmetrical corner has a square configuration.

52. The method of claim 43, wherein at least one panel of the plurality of panels comprises a dispenser tab defined by a tear line.

53. The method of claim 52, wherein the plurality of panels comprises at least one top panel, the dispenser tab is foldably connected to the at least one top panel.

54. The method of claim 43, wherein at least one end flap of the plurality of end flaps comprises a main portion, a proximal extension foldably connected to the main portion, and a distal extension foldably connected to the main portion.

55. The method of claim 54, wherein the proximal extension and the distal extension are positioned in the interior of the carton to engage the at least one article.

56. A method of forming a carton for holding at least one article, the method comprising:

obtaining a blank comprising a plurality of panels, a plurality of end flaps respectively foldably connected to a respective panel of the plurality of panels, and at least one corner section, the at least one corner section comprises a plurality of fold lines arranged in the at least one V-shaped configuration comprising a first oblique fold line intersecting a second oblique fold line at a vertex;

folding the plurality of panels to at least partially extend around an interior of the carton and folding the at least one corner section to form at least one asymmetrical corner extending between a top of the carton and a bottom of the carton and that transitions between a first configuration at one of the top and the bottom of the carton and a second configuration at the other of the top and the bottom of the carton; and folding the plurality of end flaps to form at least one closed end of the carton.

57. The method of claim 56, wherein the at least one corner section is foldably connected to at least one panel of the plurality of panels at the first oblique fold line and the at least one corner section is foldably connected to at least one end flap of the plurality of end flaps at the second oblique fold line.

58. A method of forming a carton for holding at least one article, the method comprising:

obtaining a blank comprising a plurality of panels, a plurality of end flaps respectively foldably connected to a respective panel of the plurality of panels, and at least one corner section, the plurality of panels comprises at least one top panel, at least one top panel, at least one bottom panel, a first side panel, and a second side panel;

folding the plurality of panels to at least partially extend around an interior of the carton and folding the at least one corner section to form at least one asymmetrical corner extending between a top of the carton and a bottom of the carton and that transitions between a first configuration at one of the top and the bottom of the carton and a second configuration at the other of the top and the bottom of the carton; and folding the plurality of end flaps to form a first closed end of the carton and a second closed end of the carton opposite the first closed end, the first closed end and the second closed end are each disposed between the first side panel and the second side panel, the at least one asymmetrical corner comprises a first asymmetrical corner between the first side panel and the first closed end, a second asymmetrical corner between the first side panel and the second closed end, a third asymmetrical corner between the second side panel and the first closed end, and a fourth asymmetrical corner between the second side panel and the second closed end.

59. The method of claim 58, wherein the first configuration is a curved configuration and the second configuration is a square configuration.

60. The method of claim 59, wherein at least one of the first asymmetrical corner, the second asymmetrical corner, the third asymmetrical corner, and the fourth asymmetrical corner has the respective first configuration adjacent the at least one top panel.

61. The method of claim 60, wherein at least one of the first asymmetrical corner, the second asymmetrical corner, the third asymmetrical corner, and the fourth asymmetrical corner has the respective second configuration adjacent the at least one top panel.

62. A method of forming a carton for holding at least one article, the method comprising:

obtaining a blank comprising a plurality of panels, a plurality of end flaps respectively foldably connected to a respective panel of the plurality of panels, and at least one corner section, the plurality of panels comprises at least one top panel, at least one bottom panel, a first side panel, and a second side panel;

folding the plurality of panels to at least partially extend around an interior of the carton and folding the at least one corner section to form at least one asymmetrical corner extending between a top of the carton and a bottom of the carton and that transitions between a first configuration at one of the top and the bottom of the carton and a second configuration at the other of the top and the bottom of the carton; and folding the plurality of end flaps to form a first closed end of the carton and a second closed end of the carton opposite the first closed end, the first closed end and the second closed end are each disposed between the first side panel and the second side panel, the at least one top panel comprises at least one corner portion adjacent the respective at least one asymmetrical corner, the at least one corner portion of the at least one top panel has a complementary configuration to one of the first configuration and the second configuration.

63. The method of claim 62, wherein the at least one bottom panel comprises at least one corner portion adjacent the respective at least one asymmetrical corner, the at least one corner portion of the at least one bottom panel has a complementary configuration to the other of the first configuration and the second configuration.

* * * * *